US005263627A

United States Patent [19]

Breuer et al.

[11] Patent Number: 5,263,627

[45] Date of Patent: Nov. 23, 1993

[54] MACHINE FOR ATTACHING BUTTONS, RIVETS OR THE LIKE, PREFERABLY TO ARTICLES OF CLOTHING

[75] Inventors: Theo Breuer, Stolberg; Karl J. Kochs, Baesweiler; Heinz D. Kopatz, Alsdorf; Ulrich Viering; Günter Wolfertz, both of Wuppertal, all of Fed. Rep. of Germany

[73] Assignees: Schaeffer GmbH, Wuppertal; William Prym-Werke GmbH & Co. KG, Stolberg, both of Fed. Rep. of Germany

[21] Appl. No.: 858,681

[22] Filed: Mar. 27, 1992

[30] Foreign Application Priority Data

May 31, 1991 [DE] Fed. Rep. of Germany ..... 4117767

[51] Int. Cl.[5] ..... A41H 37/10

[52] U.S. Cl. ..... 227/17; 227/18; 227/119; 227/153; 29/243.53; 29/432

[58] Field of Search ..... 227/15, 16, 17, 18, 227/119, 152, 153, 155, 68, 22; 29/432, 243.53

[56] References Cited

U.S. PATENT DOCUMENTS 3,071,046 1/1963 Conant ..... 227/17
4,007,537 2/1977 Silverbush et al. ..... 227/18
4,655,381 4/1987 Fontana ..... 227/15
4,694,984 9/1987 Altwicker ..... 227/18
4,925,099 5/1990 Hasegawa et al. ..... 227/18
5,048,741 9/1991 Toishi et al. ..... 227/18

FOREIGN PATENT DOCUMENTS 0345622 5/1984 European Pat. Off. .

*Primary Examiner*—Scott A. Smith
*Attorney, Agent, or Firm*—Martin A. Farber

[57] ABSTRACT

A machine (1) for attaching buttons, rivets or the like, preferably to articles of clothing, which buttons, rivets or the like consist of an upper part (124, 125) and a lower part (67, 68) which are fed to an upper tool (9) and lower tool (10) from magazines and are brought into form-locked connection with each other with the interposition of the material (167) by the stroke of a ram (140); in order to optimize the use of different button parts, it is proposed that the upper tool (9) and the lower tool (10) be arranged opposite each other, lying in each case one behind the other in a row on the upper (51) and lower (48) arms of a U-shaped carriage (30) by the positioning of which the upper tool (9), which is to be placed in action in each case, enters into coupling position with respect to the ram (140).

16 Claims, 30 Drawing Sheets

III
IV
V
22
24
8
26
1
36
35
31
34
38
39
28
142
143
144
140
145
138
146
157
147
9
32
33
42
165
166
41
127
148
149
40
161
135
134
128
129
82
94
85
F
81
141
50
101
43
44
51
47
30
99
84
98
126
92
83
54
100
97
89
86
91
49
53
10
80
48
52
29

IX
IX
9
8
28
28
32
32
33
33
34
34
38
38
39
39
40
41
42
43
44
45
46
46
47
50
51
105
106
107
126
127
128
129
134
135
140
141
148
149
150
151
152
153
154
155
156
157
159
160
161
162
164
165

MACHINE FOR ATTACHING BUTTONS, RIVETS OR THE LIKE, PREFERABLY TO ARTICLES OF CLOTHING

FIELD AND BACKGROUND OF THE INVENTION

The present invention relates to a machine in accordance with the preamble to claim 1.

A machine of the type in question is known from EP 0 345 622 A22 in which, viewed from the position of operator of the machine, two working positions arranged parallel to each other are present. Each working position consists of a bottom tool and a top tool as well as a stroke ram bearing the top tool. As force transmission agent, there is employed a crank drive which acts on a double-arm rocker. One or the other stroke ram can be coupled optionally to this rocker via a switch means.

SUMMARY OF THE INVENTION

The object of the invention is so to develop a machine of this type that buttons, rivets, etc., of different shape can optionally be optimally attached.

As a result of the invention, there is provided a machine of the introductory mentioned type in question which is characterized by optimal operation thereof. No longer are there two working positions arranged parallel to each other as seen from the operator of the machine, but rather only a single working position. Nevertheless, the attachment of buttons and rivets of different shape consisting of upper and lower parts is possible. This is due to the arrangement of the upper and lower tools in a row one behind the other opposite the upper and lower arms of the U-shaped carriage. An axially aligned position of the upper and lower tools in use at the time is therefore always established. The tools need not be brought into their aligned position with respect to each other. Optimal connections of the upper and lower parts of the buttons, rivets, etc. are therefore produced. Furthermore, the single working position facilitates alignment of the article of clothing with respect to it, in contradistinction to two working positions such as present in the prior art. The percentage of errors caused by improper alignment of the article of clothing is thereby considerably reduced. By means of a program control it is possible only in accord with the article to be attached to move the carriage by the corresponding amount, in which position the upper tool which is to be caused to act in each case comes into coupling position with the ram. The direction of displacement of the ram is therefore at the same time the direction of displacement of the upper tool, so that, seen as a whole, a favorable transmission of force results, together with a compact construction of the machine. If at least three upper tools arranged in a row one behind the other are provided, the middle one being a piercing tool, corresponding articles of clothing can be completely equipped with the buttons, rivets, etc., to be attached. The piercing tool is preferably formed by a cross-type cutter so that after the piercing, a crosswise slit is present in the material for the passage of the shank of the corresponding button part. In each case, one upper part and one lower part form a button part, consisting of the holding part and function part. The middle piercing tool then makes it possible to provide normally shaped holding parts with sleeve-shaped shank without said shank having to be specially sharpened. Button parts which are economical to produce can accordingly be used. Since the piercing must take place before the attachment, the carriage fundamentally moves into the position in which the piercing tool is coupled with the ram. In order that the material be held immovable both during the piercing and during the attachment of the corresponding button part, clamping surfaces which clamp the material are arranged below the ram at the height of the free U-space. The clamping surfaces move in advance for the final positioning of the carriage into the clamping position. The upper clamping surface can be controlled by a finger guard which prevents accidents. Existing structural parts can therefore be included in a multiple function. Furthermore, two adjoining displacements for the positioning of the carriage are provided in accordance with the invention. The first displacement of the carriage serves for the associating of the central piercing tool with the ram. After the piercing has been effected, the second displacement of the carriage takes place, in which one or the other adjacent upper tools comes into coupling position with the ram. During these successive displacements, the clamping position of the clamping surfaces with respect to the article of clothing is never left. A button part is therefore attached always at the place where a hole has already been made. This measure is favorable also for sensitive fabrics. Furthermore, the upper tools are guided in the upper U-arm in vertically displaceable manner transverse to the direction of displacement. Vertical displacement can be effected already by an oblique slot guide during the displacement of the carriage. In this way, assurance is had that the upper tool which enters into use comes dependably into coupling position with respect to the ram. A first drive serves to effect the first displacement of the carriage. This is the position in which the piercing hole enters into action. The following second displacement is then effected by means of a separate drive, either forward or backward, as seen from the position of the hole. The resilient free path in the drive for the first displacement path for the displacement of the carriage by means of the second drive permits the displacement of the carriage into the forward or rearward shifted position. This resilient free path furthermore prevents destructive compulsive forces from occurring, caused for instance by foreign bodies or a jam in the transport of the button part. The drive for the first displacement path is formed by the control arm of a cam gear. The latter acts on a pin of the carriage and has two arms on both sides of the pin which can be spread apart against spring action. Depending on the direction in which the carriage is moved out of its central position, one or the other arm is swung against the spring action. As a result of the spring loads, both arms upon the backward movement of the carriage act against the pin and produce the starting position, so that upon renewed displacement forward of the carriage from its basic position, the middle position is always reached. As a result of the correspondingly shaped head parts of the upper tools, the corresponding head parts upon the displacement of the carriage pass automatically into the coupling position with respect to the ram. As a result of a form-locked connection, created by two grooves facing each other on the head parts, the entrance/passage of coupling attachments of the ram is assured. In the entrance position, therefore, the corresponding upper tool is positively carried along in both directions by the ram. The drive for the second displacement path of the carriage is effected by means of the program-controlled control lever acting on the upper carriage arm. Depending on the position into which this lever is swung under the control of the program, which depends on the article to be attached at the time, the carriage is moved from its central position in which the piercing is effected either in one or the other direction in which the corresponding head part of the corresponding upper tool comes into coupling position with respect to the coupling attachments of the ram. While the clamping surface which lies on the upper-tool side is controlled by the movement of the finger guard, the lower-tool-side clamping surface is formed of two sections lying one behind the other in the direction of the displacement, one of which is spring urged in the clamping direction and the other moved by the displacement movement of the carriage in the clamping direction. The bipartite nature of the lower clamping surface furthermore provides the advantage that the corresponding regions of the articles of clothing to be provided with buttons are always dependably held both during the piercing of the article of clothing and upon the attachment of the corresponding button part. For the piercing, the ram moves with a piercing tool completely into the lower ram position. The ram then moves back a small amount. This is followed by the second path of displacement of the carriage. The ram together with the corresponding upper tool then moves again into its lower end position, producing the connection between the lower and upper parts of a button. The ram then moves again upward so that with a 360° rotation of a crank drive controlling the ram both the piercing process and the connecting process are carried out.

BRIEF DESCRIPTION OF THE DRAWINGS

One embodiment of the invention will be explained below with reference to the drawings in which.

DETAILED DESCRIPTION OF THE PREFERRED EMBODIMENT

Figure 1:
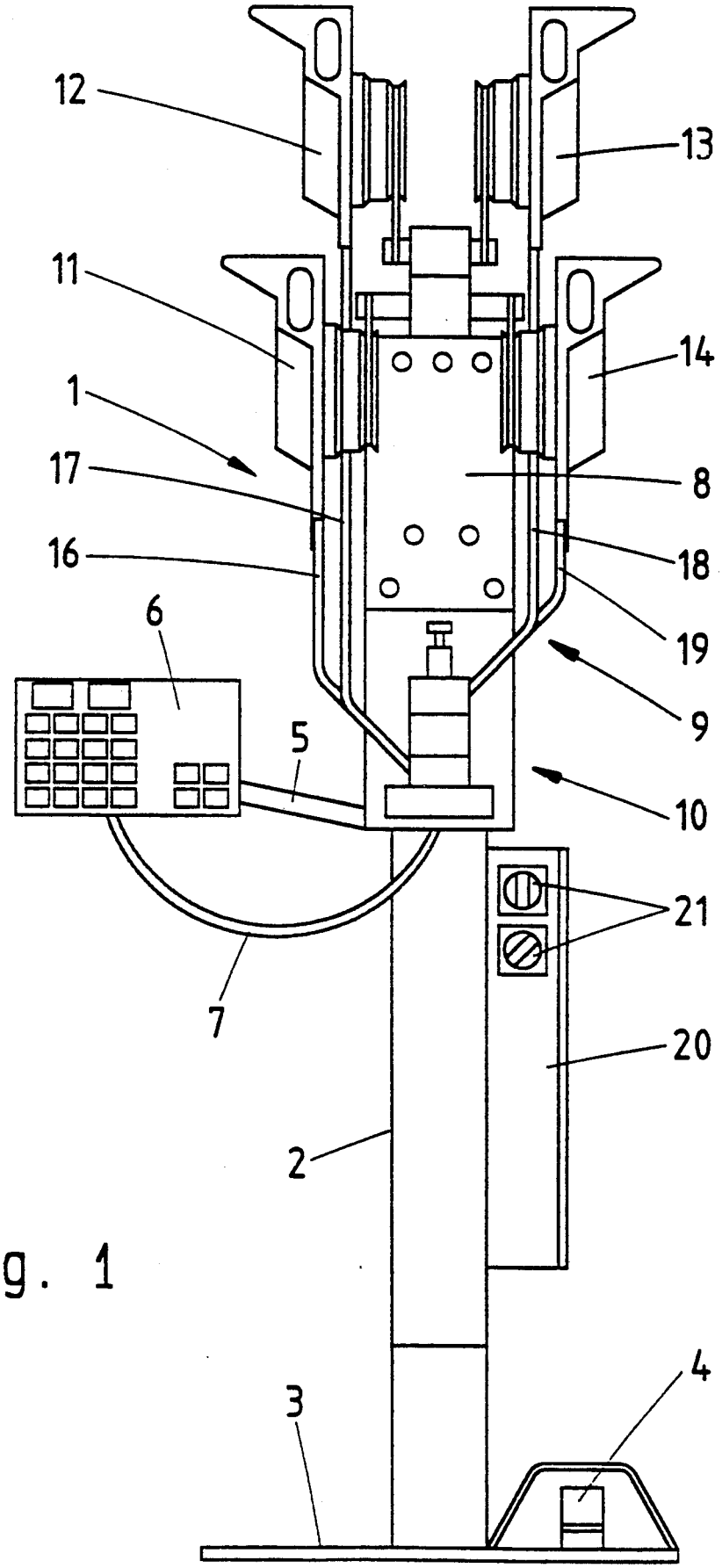
FIG. 1 is a front view of the attachment machine of the invention.

FIG. 1 shows an attachment machine 1 for the fastening of buttons, rivets or the like. It has a foot 2 on the machine-frame side, the foot being provided with a standing plate 3 on which a pedal switch 4 is arranged. The attachment machine 1 can be placed in operation by means of the pedal switch 4. On a protruding arm 5 there is fastened a control desk 6 which is connected by a cable 7 to the machine control. The desired attachment program can be entered by means of the control desk 6.

Above the foot 2, the actual machine parts are arranged in part within a housing which substantially receives an upper tool 9. Furthermore, four magazines 11 to 14 are provided which are driven by belt drive in order to transfer the individual button parts lying in the magazines 11 to 14 in proper position to the feed rails 16 to 19 extending from the magazines, which rails conduct the individual button parts to the corresponding positions in the upper tool 9 and lower tool 10.

In the showing of FIG. 1, the covering of the upper region of the attachment machine 1 has been removed so that the inner construction can be noted. On the foot 2 there is furthermore fastened an electric connecting box 20 which has switches 21 which permit selection of the type of operation.

Figure 2:
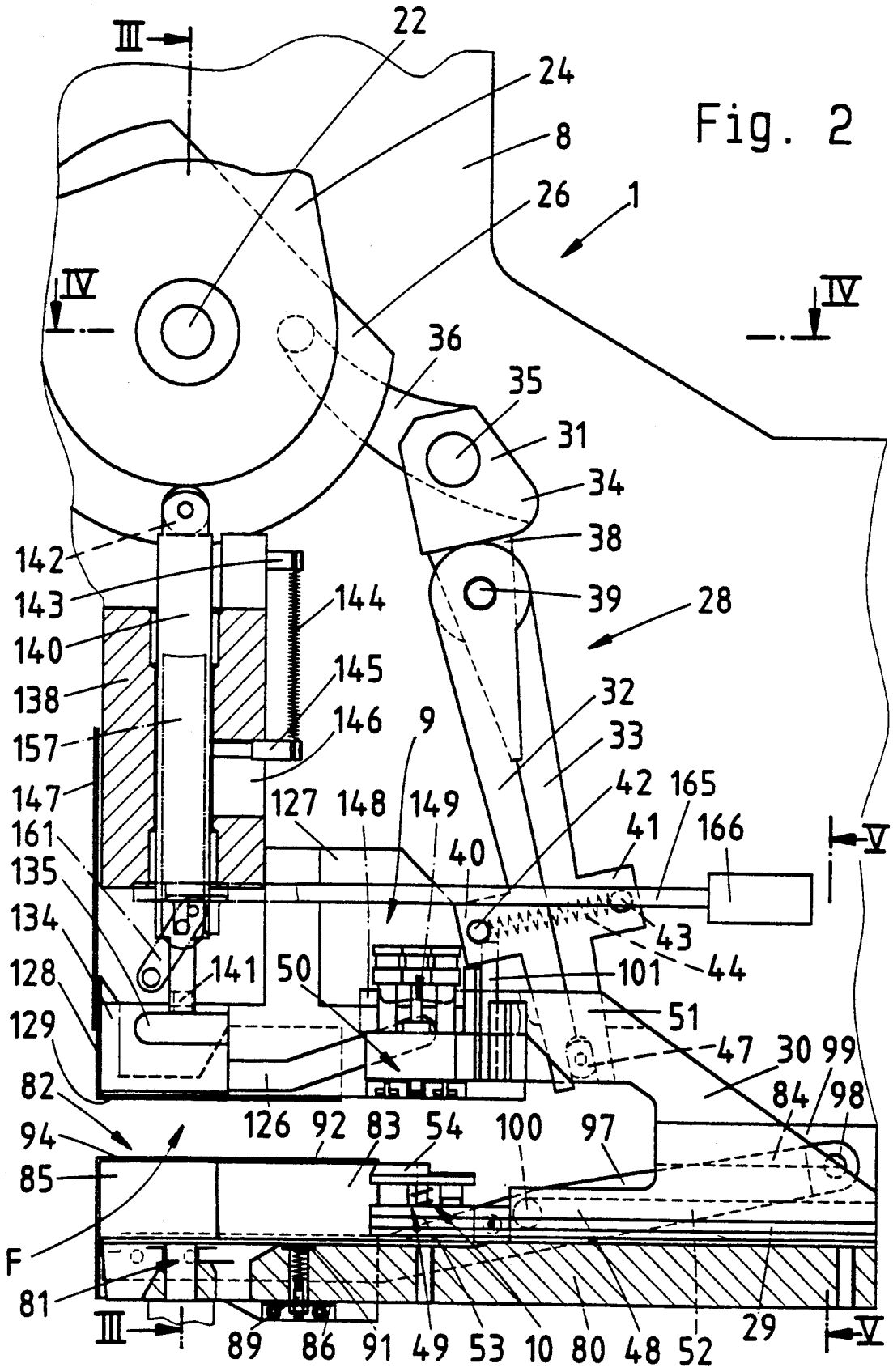
FIG. 2 is a longitudinal section of the machine in the region of the U-shaped carriage.
Figure 3:
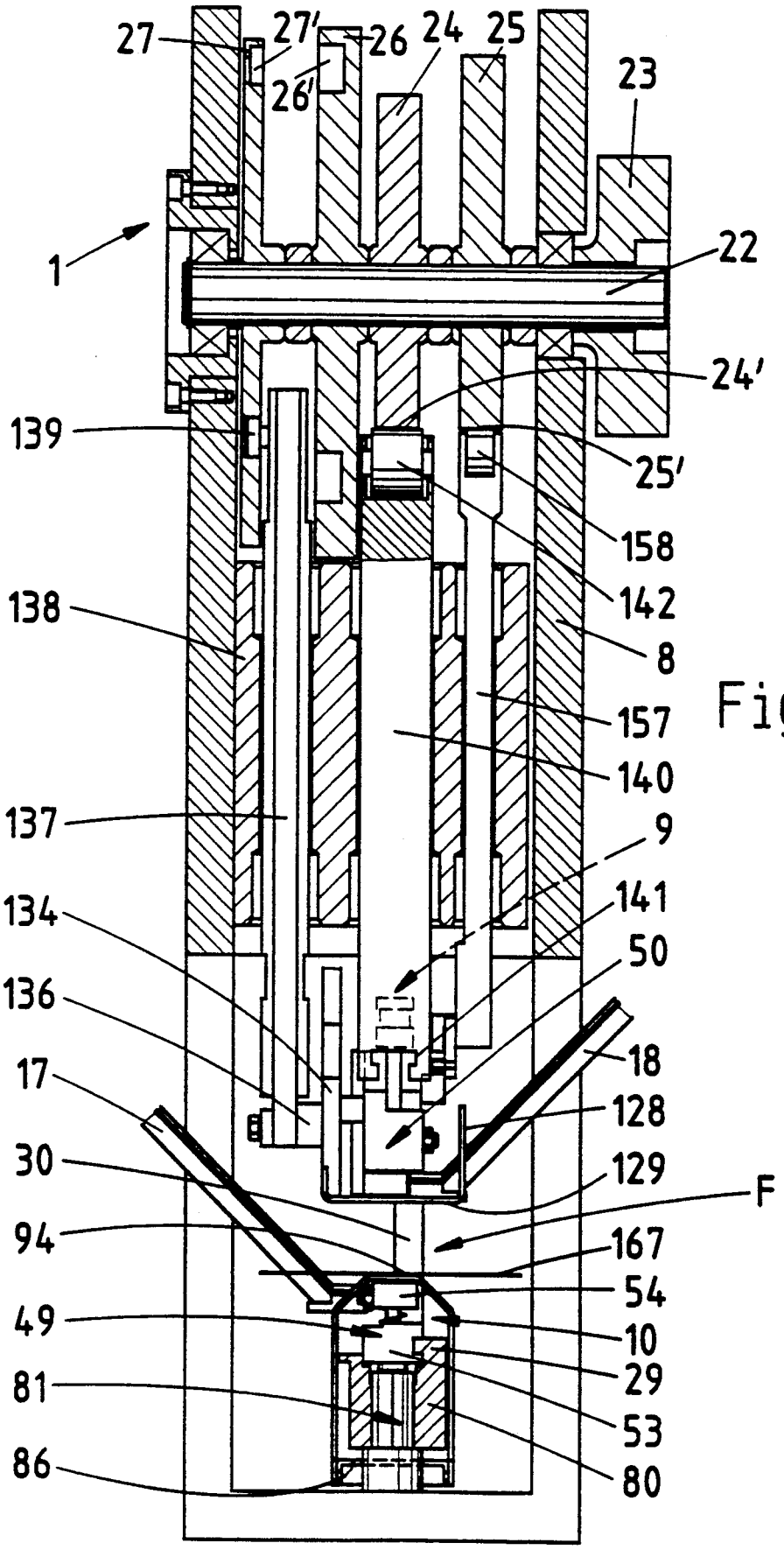
FIG. 3 is a section through the machine in the region of the crank drive of the upper and lower tools along the line III—III of FIG. 2.
Figure 4:
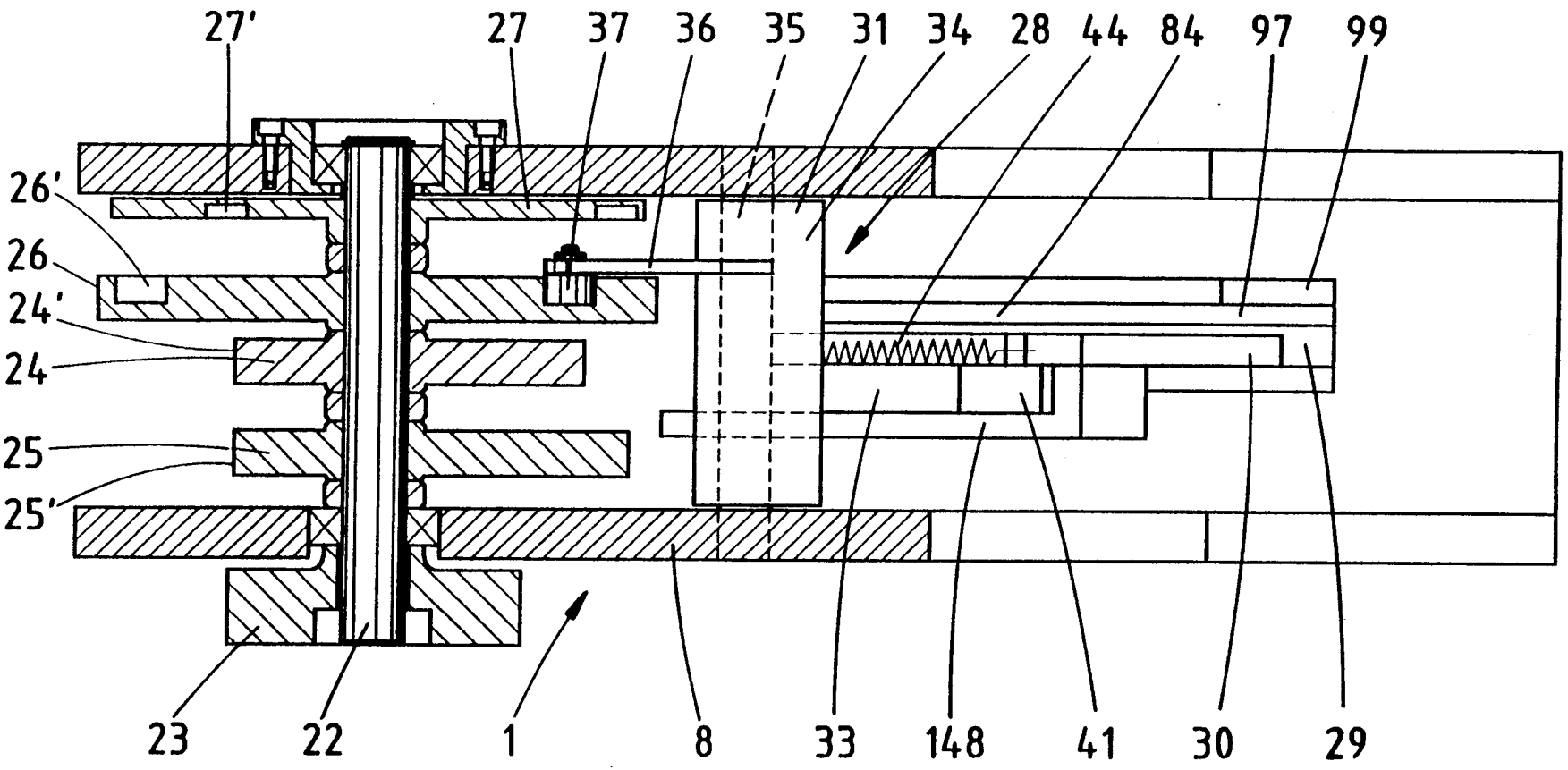
FIG. 4 is a section along the line IV—IV of FIG. 2.
Figure 5:
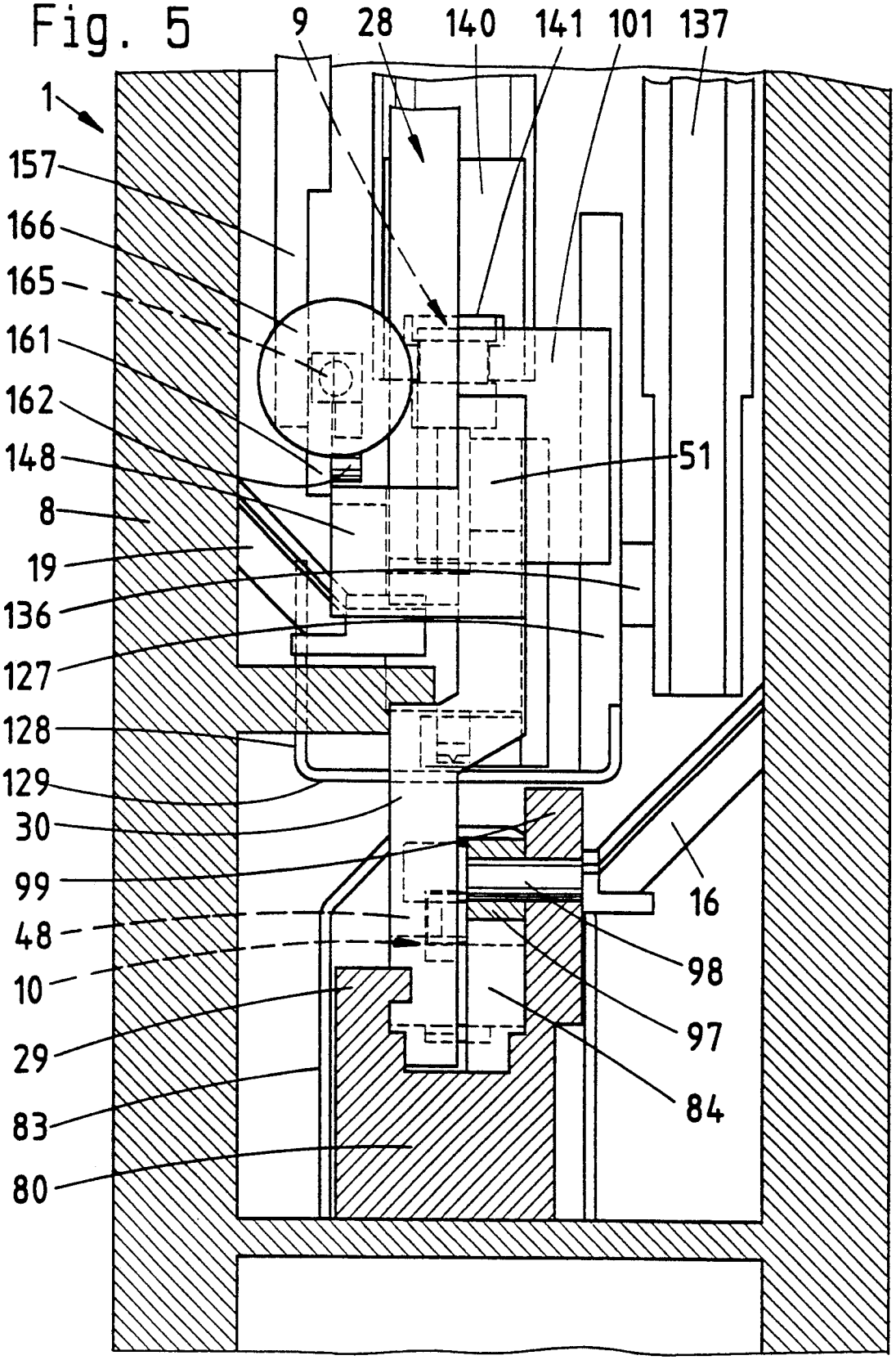
FIG. 5 is another section, but on a larger scale, along the line V—V of FIG. 2.
Figure 6:
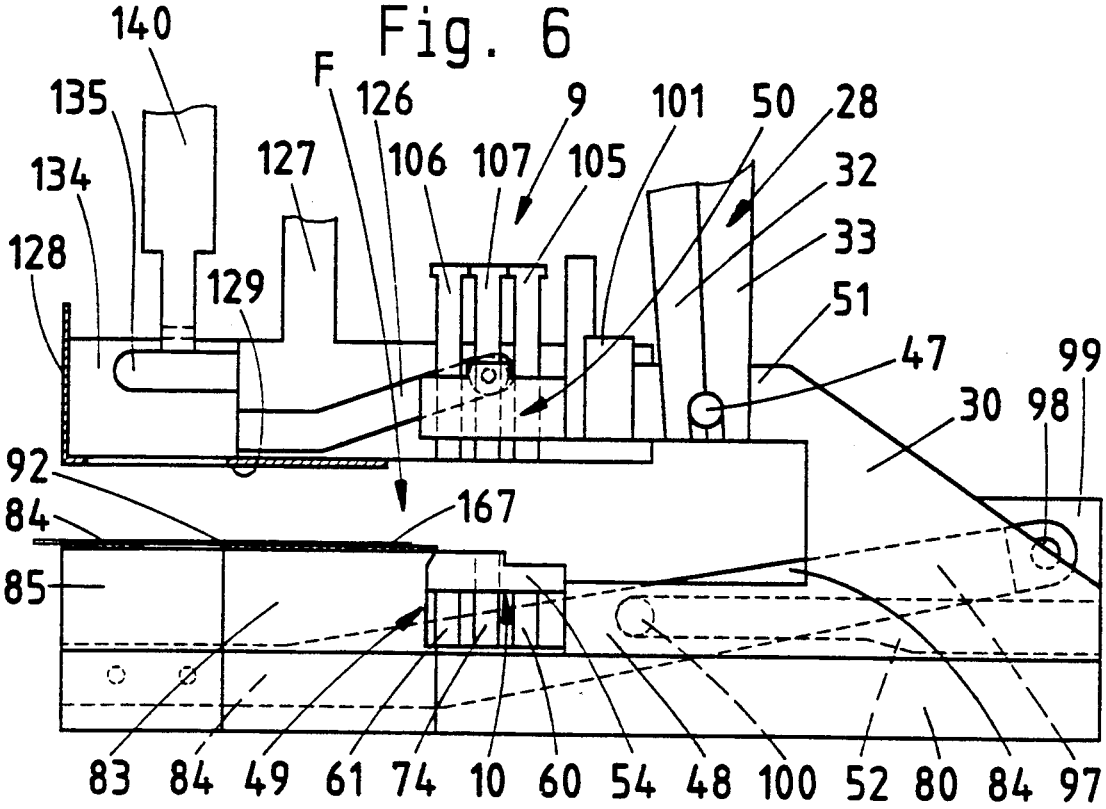
FIG. 6 diagrammatically shows the region of the U-shaped carriage bearing the upper and lower tools, the carriage being in its basic position.

The arrangement of the individual elements of the attachment machine 1 can be noted from FIGS. 2, 3 and 4. Four cam disks are arranged on a drive shaft 22 mounted in the housing 8. One free end of the drive shaft 22 extends out of the housing 8 and is provided there with a coupling element 23 via which the shaft 22 and thus the cam disks are also driven by an electric motor (not shown). Centrally, between the side walls of the housing 8 a ram cam disk 24 is fastened on the drive shaft 22. On the right, alongside the ram cam disk 24, as seen from the operator of the attachment machine 1, there is an auxiliary control cam disk 25. Opposite this auxiliary control cam disk 25 a carriage control cam disk 26 is placed on the drive shaft 22. The finger-guard cam disk which is arranged on the left thereof bears the reference numeral 27. While in the case of the ram cam disk 24 and of the auxiliary control cam disk 25 the control paths are scanned on the radial surfaces 24' and 25' respectively, the carriage control cam disk 26 and the finger-guard cam disk 27 are provided with cam slots 26' and 27' respectively.

The carriage control cam disk 26 controls, via a lever 28, a carriage 30 which is guided on a rail 29.

The lever 28 is formed of an elbow lever 31 and two swing arms 32, 33 pivotally mounted thereon. The elbow lever 31 has a central part 34 to receive a shaft 35 which is mounted in the side walls of the housing 8. This central part 34 is provided with an extension 36 which on its free end serves to mount a gripping roller 37 which rests in the cam slot 26' of the carriage control cam disk 26. At an angle of about 135° to the alignment of the extension 36 a wedge extension 38 is developed on the central part 34, it having a hole to receive a turn shaft 39. On both sides of the wedge-shaped extension 38 the swing arms 32, 33 are swingably mounted. The swing arms 32, 33 are so developed as to obtain a scissor-like manner of action. In their lower region each of the swing arms 32, 33, has a lug 40, 41 bearing a pin 42, 43, respectively. Between these pins 42, 43 there is connected a tension spring 44 which keeps the spring arms 32, 33, in closed position (see FIG. 2). The transmission of force from the elbow lever 31 to the swing arms 32, 33 takes place via the wedge-shaped extension 38. Depending on the direction of action, its side surfaces act on a partial region of the corresponding side surface of a swing arm 32 and 33 respectively. The holding force of the tension spring 44 is in this connection greater than the force acting via the wedge-shaped extension 38 on the swing arms 32 and 33. On their free end region each of the swing arms 32, 33 has a cutout 45, 46. In the closed position of the swing arms 32, 33 which are arranged in scissor shape, they lie opposite each other in such a manner that they form a recess for a transmission pin 47 rotatably mounted in the carriage 30.

On the lower arm 48 of the carriage 30, there is a lower tool holder 49. Vertically above this lower tool holder 49 there is an upper tool holder 50 which is vertically adjustable transverse to the direction of displacement of the carriage 30 on the upper arm 51 on which the lever 28 also acts via the transmission pin 47. In the region of the lower arm 48 the carriage 30 has a lateral slot 52 which widens downward to the end of the lower arm 48 opposite the lower tool holder 49.

Figure 11:
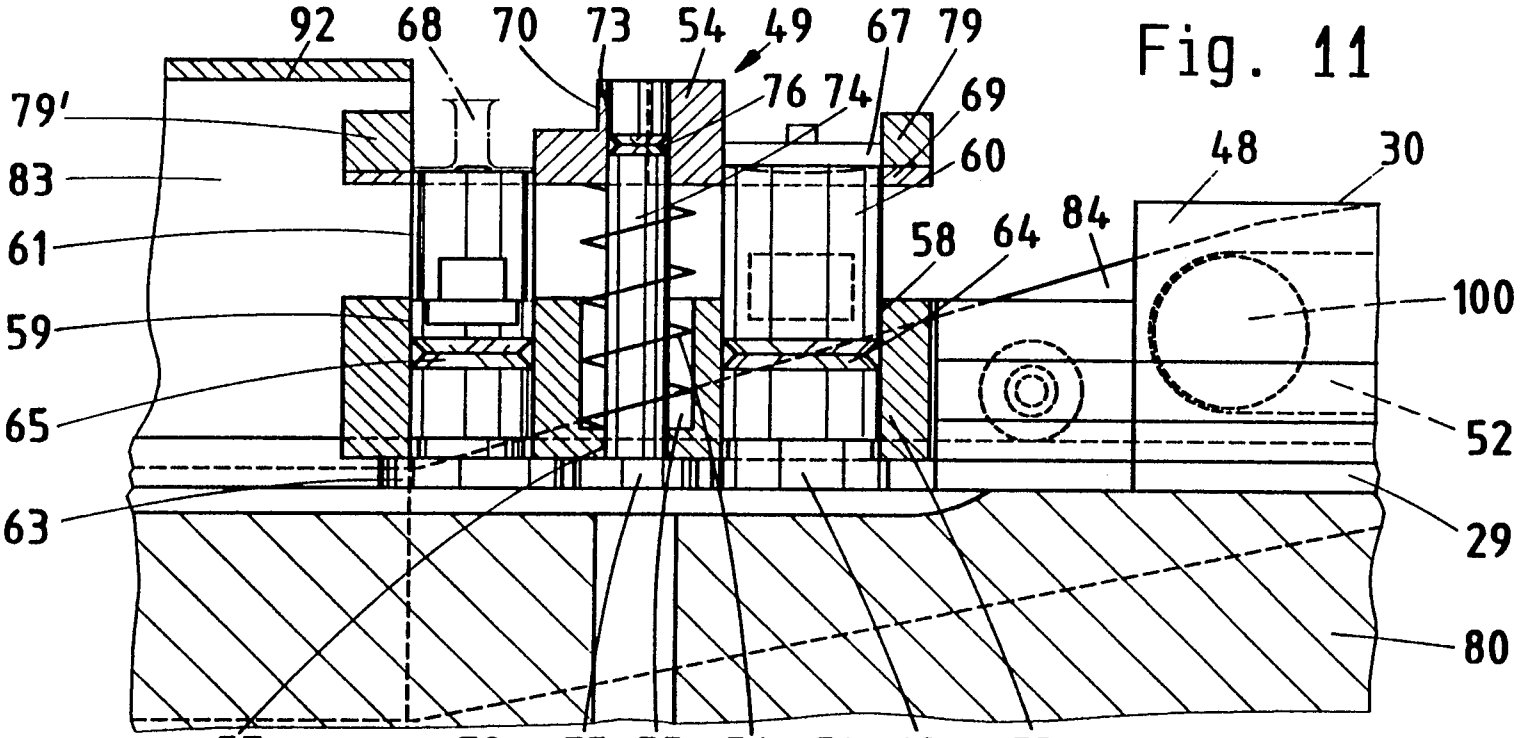
FIG. 11 is a longitudinal section in the region of the lower tool.
Figure 12:
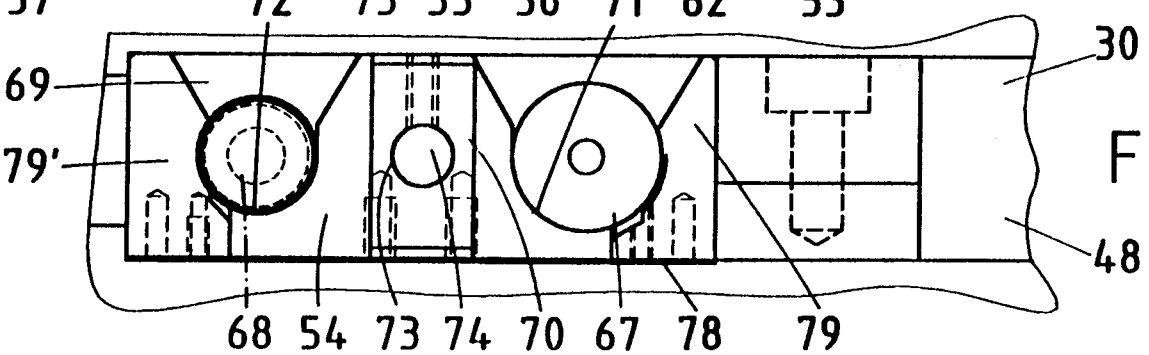
FIG. 12 is a top view of the lower tool.
Figure 16:
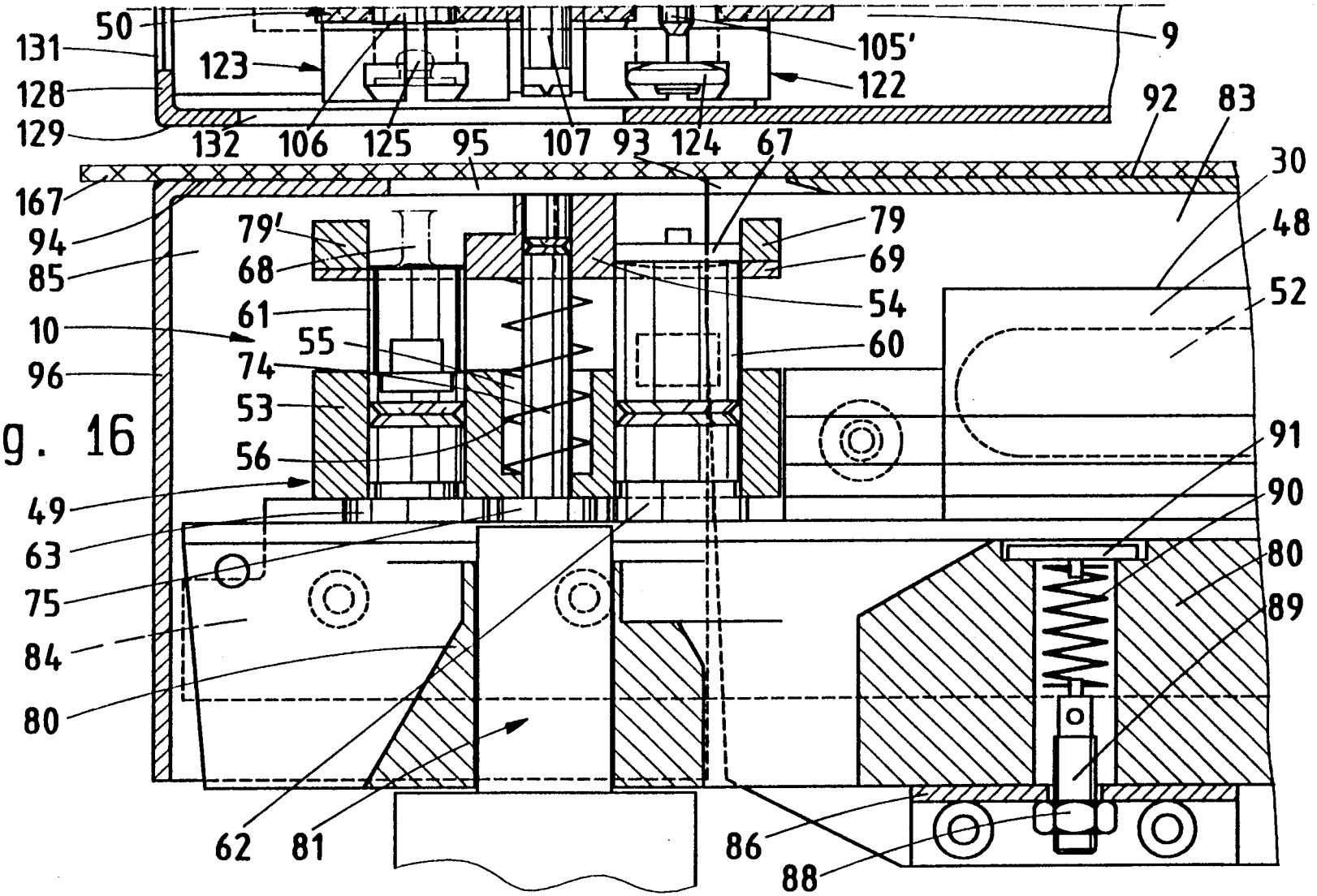
FIG. 16 is a showing in accordance with FIG. 7 in which the clamping surface lying on the upper tool side and the upper tool itself are partially lowered for the finger-guard scanning.

The lower tool holder 49 consists essentially of a tool frame 53 and a receiver 54, the tool frame 53 having at its center a blind hole 55 to receive a compression spring 56. Within the region of the blind hole 55, the tool frame 53 has a hole 57 of smaller diameter than the blind hole 55. Furthermore, the tool frame 53 has two radial openings 58, 59 which are arranged in front of and behind the blind hole 55 respectively in the direction of displacement of the carriage, the radial opening 59 being of smaller cross section than the radial opening 58. As can be noted from FIG. 11, the radial opening 58 receives a rivet part 60 and the radial opening 59 receives a rivet part 61. Both rivet parts 60, 61 rest against the bottom of the tool frame 53 with, in each case, a semicircular shoulder 62, 63. Within the region of the radial openings 58, 59, each of the rivet parts 60, 61 is provided with a constriction 64, 65. A detent ball 66, arranged under spring action in the side surface of the tool frame 53, engages into each constriction 64, 65. The positioning of the rivet parts 60, 61 in the tool frame 53 is thus established. In the upper region, the rivet parts 60, 61 are developed in accordance with the button lower parts 67, 68, to be received. It is intended during one operation to provide only one rivet part 60 or 61 with a button lower part 67 or 68. In the drawings shown, it is assumed that the rivet part 60 receives a button lower part 67. In FIGS. 11 and 16 this has been shown in dash-dot line in order to make clear the arrangement of the other button lower part 68. The receiver 54 is so arranged in the lower tool holder 69 that it surrounds the upper regions of the rivet parts 60, 61, the top side of the receiving bottom 69 being aligned with the top sides of the rivet parts 60, 61. In the middle region of the receiver 54 the latter has a thickening 70 which extends in each case to approximately the axial center points of the rivet parts 60, 61, the thickening 70 having radial recesses 71, 72 in the region of the rivet parts 60, 61. Vertically above the hole 57 of the tool frame 53, the receiver has an opening 73 of the same size. The hole 57 of the tool frame 53 and the opening 73 of the receiver 54 are passed through by a punch 74 which rests on the bottom of the tool frame 53 via an annular shoulder 75. The length of the punch 74 is such that its upper edge is flush with the surface of the thickening 70 of the receiver 54. In the region of this thickening 70 the punch 74 also has a constriction 76 into which a detent ball 77 arranged under spring action in the thickening 70 engages in order to fix the punch 74 in position. In the region of a side surface of the thickening 70 a leaf spring 78 is fastened to it. This leaf spring 78 bears a clamping piece 79, 79' on each of its two free ends. This arrangement results in a dependable clamping seat for a button lower part 67, 68 on the corresponding rivet part 60, 61.

Below the lower tool holder 49 and thus also below the rail 29, which guides the carriage 30 there is an anvil ledge 80 which extends from the rear end of the U-shaped carriage 30 up into the front working region of the attachment machine. In the front working region the anvil ledge 80 receives a pressure equalization device 81. The latter, as is known, consists of two semicylinders which are acted on by pressure in different amounts in the direction towards the lower tool.

Figure 10:
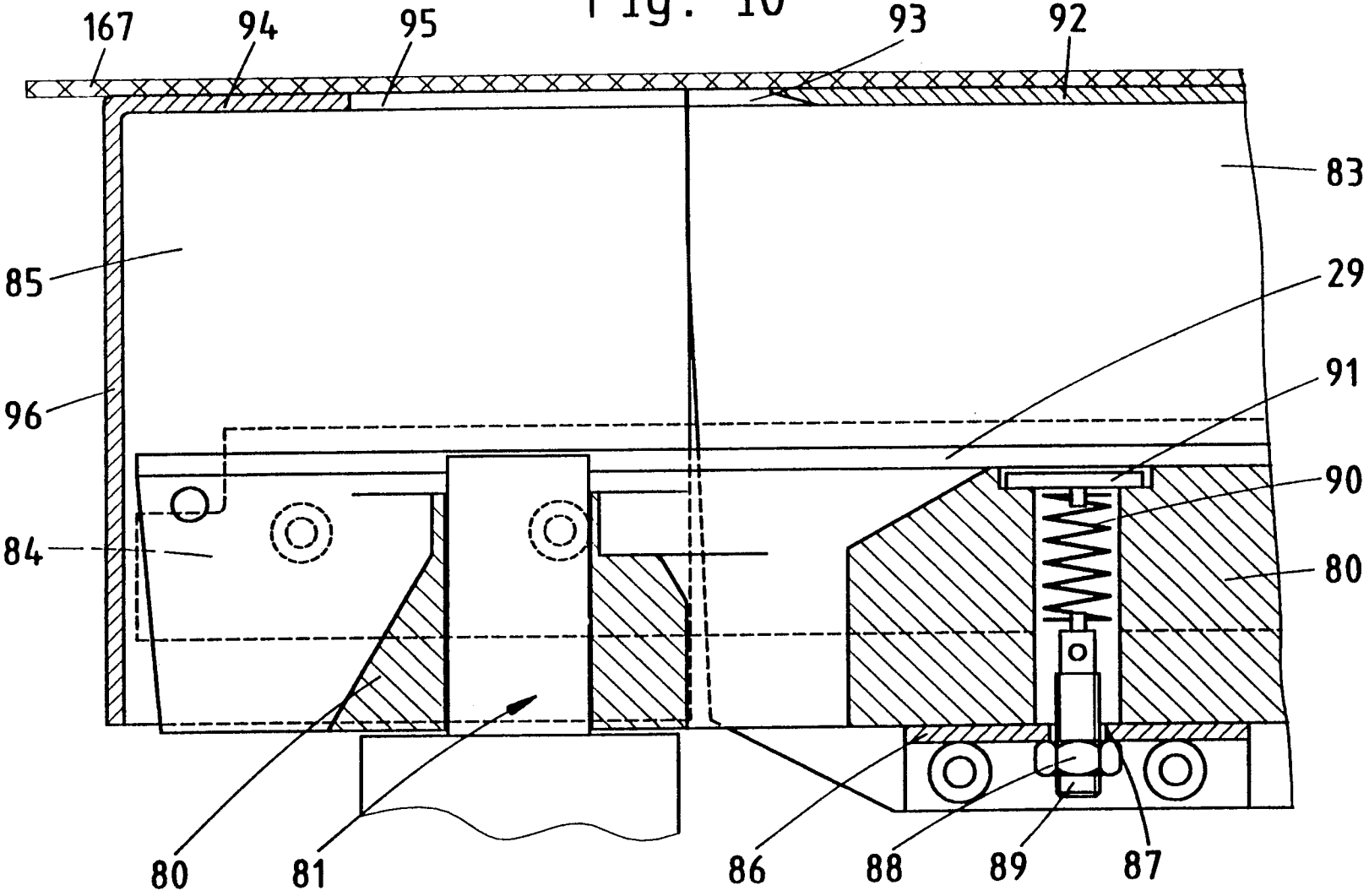
FIG. 10 is an enlarged showing of the lower working region, the clamping surfaces arranged there being held in their basic position.

In the front working region of the attachment machine 1 a bipartite work platform 82 is provided. This work platform 82 is formed of a spring-loaded protective hood 83 and a platform 85 resting on a swing arm 84. The protective hood 83 is of U-shape and engages over both sides of the anvil ledge 80. In the lower region of the U arm of the protective hood 83 a stop 86 is arranged on its inner sides, the stop having a hole 87 in its center. This hole 87 is passed through by a threaded pin 89 provided with a nut 88, the pin 89 having a projection on its free end to receive a tension spring 90. This tension spring 90 has its other free end fastened to an opposing plate 91 inserted in the anvil ledge 80. The nut 88 in this connection acts on the bottom of the stop 86 which thus rests under spring load against the bottom of the anvil ledge 80. By this development, the protective hood 83 is continuously acted on in the direction of the free U-space of the carriage 30. In the unloaded basic position (see FIGS. 10 and 11), the work platform is so aligned that the lower edge of the work surface 92 of the protective hood 83 lies approximately at the same height as the top of the receiver 54 of the lower tool holder 49. In the end region which is opposite the lower tool holder 49 in the basic position of the attachment machine 1 a recess 93 is provided in the work surface 92.

The platform 85 is arranged in front of the protective hood 83 as seen by the operator of the attachment machine. In the region of its work surface 94 it has a slot 95 which adjoins the recess 93 in the protective hood 83. The U-shaped platform 85 is provided with a front closure plate 96 on its side opposite the protective hood 83. The work surface 94 of the platform 85 lies in the basic position (see FIG. 13) at the same height as the work surface 92 of the protective hood 83, the platform extending downward to the lower edge of the anvil ledge 80.

The platform 85 is held via a swing arm 84 which is screwed in the platform 85 in the lower region of the platform. This swing arm 84 extends parallel to the platform 85 and to the protective hood 83 in the region of the anvil ledge 80. Adjoining this, the swing arm 84 continues as bent-off section 87 up into the end region of the anvil ledge 80. Here the anvil ledge 80 has a lug 99 provided with a shaft 98. The swing arm 84 is turnably mounted on the shaft 98. The swing arm 84 is supported in the region of the slot 52 of the carriage 30. The swing arm 84 rests in this connection via a guide roller 100 arranged on its side in the slot 52 in such a manner that the platform 85 arranged on the free end of the swing arm 84 is at the same height as the protective hood 83 in the basic position of the application machine 1.

Vertically above the lower tool holder 49 the upper tool holder 50 is arranged on the upper arm 51 of the carriage 30. For this purpose, the upper arm 51 has a receiving plate 101 on which the upper tool holder 50 is vertically displaceable via a groove and tongue joint. In the extension of the axes of the rivet parts 60, 61 and of the punch 74 of the lower tool holder 49, the upper tool holder 50 has holes 102, 103, 104 to receive two rivet rams 105, 106 and a punch ram 107. All three rams have constrictions 108, 109, 110 in the region of the upper tool holder 50. For the fixing in position of the rams, the same procedure is used here as in the case of the lower tool holder 49, spring-loaded detent balls 111, 112, arranged in the upper tool holder 50, holding the rams in place in the region of their constrictions.

The lower edge of the rivet ram 106 terminates at the height of the lower edge of the upper tool holder 50. In contradistinction to this rivet ram 106, the rivet ram 105 is provided on its lower side with a mandrel 105' which also terminates approximately at the height of the bottom of the upper tool holder 50. The punch 107, arranged centrally between the rivet rams 105 and 106, has its lower end extending beyond the bottom of the upper tool holder 50 and it is provided in its end region with a hole cutter 113 in the form of a crosswise arm to produce cross-slot holes. All three rams have a length which corresponds to twice the height of the upper tool holder. In their upper end region the rams are provided with cylindrical receivers 114, 115, 116, they being fixed on the corresponding rams by threaded screws 117. These cylindrical recesses 114, 115, 116 have substantially a larger cross section than the corresponding rams. In the central region of the cylindrical recesses, they have a zone 118, 119, 120 of reduced cross section.

Centrally, in the region of the punch 107, a roller 121 is arranged on a side surface of the upper tool holder 50. On the same side, a pair of tongs 122, 123 to receive button upper parts 124, 125 are associated in each case with a rivet ram 105, 106. Such a pair of tongs 122, 123 consists essentially of two L-shaped arms, the longer arms of which are mounted turnably on the side surface of the upper tool holder 50 and which, on their shorter arms extending below the upper tool holder 50, have recesses to receive the corresponding button upper part 124, 125. The pair of tongs 122, 123 is urged into a closing position by a tension spring arranged between the corresponding tong arms so that the button upper parts 124, 125 lying in the recesses of the lower arms are always secured by a clamp seat.

Figure 17:
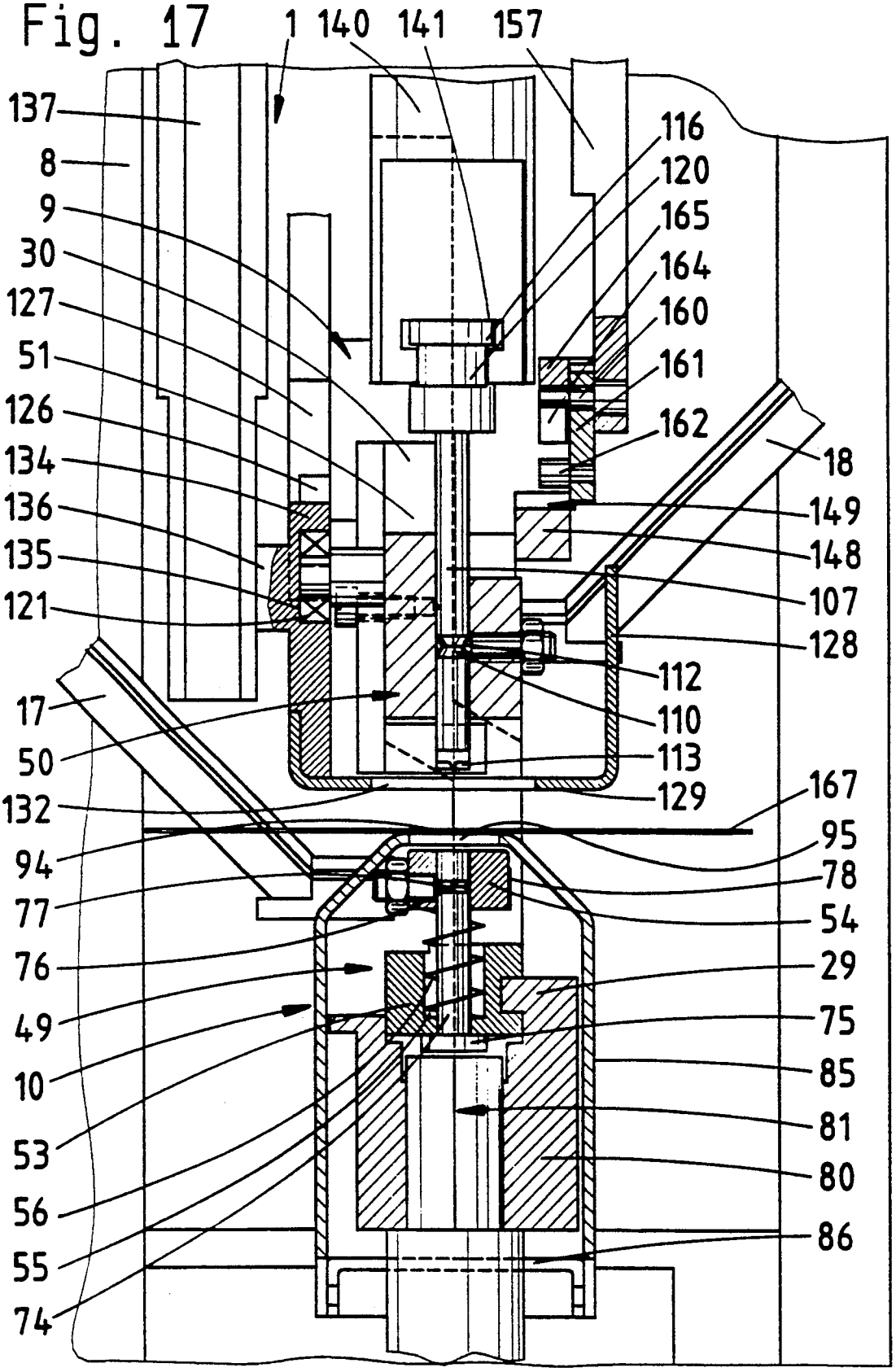
FIG. 17 is a longitudinal section in the region of the upper and lower tools in accordance with FIG. 16.

Also in the case of this upper tool holder, the upper tool holder 50 is loaded with only one button upper part 124 or 125 upon one operation of the attachment machine 1. The button upper part 125 shown in FIGS. 13 and 17 serves merely to show the position of this button part.

The vertical displacement of the upper tool holder 50 is effected by means of the aforementioned roller 121 which rests in an oblique slot guide 126 in a guide plate 127 which is firmly attached to the housing 8.

Adjoining the guide plate 127, as seen from the upper tool holder 50, there is provided a finger guard hood 128. It, in the same way as the work platform 82, is developed substantially in U-shape, the upper edge of the U-web 129 terminating with the lower edge of the guide plate 127. This U-web 129 extends in this connection, in the basic position of the attachment machine 1, to approximately the region of the upper tool holder 50. The finger guard hood 128 is provided with a closure plate 130 on the side thereof opposite the guide plate 127.

In order to facilitate the alignment of material upon the operation of the attachment machine 1, openings 131, 132 are provided both in the closure plate 130 and in the U-web 129, by which openings the point of attachment can be fixed. The opening 131 in the closure plate 130 is preferably provided with a transparent covering 133.

The finger guard hood 128 is connected on one of its side arms with a guide 134. This guide 134 is provided on the side pointing into the U-shaped space of the finger guard hood 128 with a slot 135 having the same width as the oblique-slot guide 126 of the guide plate 127. The said slot 135 is shifted vertically with respect to the end region of the oblique slot guide 126 in the basic position of the application machine 1. On the side of the guide 134 opposite the slot 135, the guide is provided with a device 136 for the attachment of a push rod 137. This push rod 137 passes through a ram guide 138 arranged in the housing 8 and its free end engages via a contact roller 139 into the control cam slot 27' of the finger guard cam disk 27.

An end region of a ram 140 extends centrally into the region of the U-shaped space of the finger guard hood 128. In the basic position of the attachment machine 1 the lower edge of said ram 140 is approximately at the height of the upper edge of the slot 135 in the guide 134 (See FIG. 13). As can be noted from FIG. 17, the ram 140 is provided in its lower end region with a T-shaped recess developed as coupling attachment 141. This recess is directed towards the upper tool holder 50. Starting from said lower region, the ram 140 also passes through the ram guide 138 and rests via its upper end having a gripper roller 142 mounted in this region against the radial surface 24' of the ram cam disk 24.

The ram guide 138 has a pin 143 in the region of the passage of the ram 140, a tension spring 144 acting on the free end of said pin. Another pin 145 is arranged perpendicular to the pin 143 on the ram 140 and receives the other free end of the tension spring 144. This pin 145 passes through the ram guide 138 in the region of a slot 146 aligned in the direction of movement of the ram 140. As a result of this development, the ram 140 is always spring-urged in the direction towards the ram cam disk 24.

The front region of the finger guard hood 128 and of the ram guide 138 is protected by a cover 147.

The carriage 30 is provided in the region of its upper U-arm with a control arm 148 which extends from the latter and parallel to it. In this connection, it passes on the side of the upper arm 51 which is opposite the lever 28 and extends up into the region of the upper tool holder 50. Here the control arm 148 has a control guide 149 extending from the upper edge of said control arm 148 and formed essentially of two mirror-image control sections 150, 151. The mirror axis of these control sections 150, 151 lies at the same height as the longitudinal axis of the punch ram 107 of the upper tool holder 50. The central region of the control guide 149 is formed by a dome 152 from which there extend control surfaces which are passed downward on both sides at an angle of about 5°. Approximately in the region parallel to the longitudinal axes of the rivet rams 105, 106 of the upper tool holder 50 the control guide 149 is limited by control stop surfaces 155, 156.

A control lever 157 extending parallel to the ram 140 is provided on the side of said ram opposite the push rod 137. Said lever passes through the ram guide 138 in the region of the housing 8 and its upper free end rests via a gripper roller 158 on the radial surface 25' of the auxiliary control cam 25. The spring-loaded aligning of the control lever 157 in the direction towards the auxiliary control cam 25 is effected in the same manner as in the case of the ram 140, but is not shown in the drawing. The control lever 157 terminates above the guide 134 of the finger guard hood 128. Within this end region there is a hole 159 to receive a shaft 160 on which a tilt lever 161 is turnably mounted on the side of the control lever 157 facing the ram 140. On one of its free ends there is arranged on the tilt lever 161 a control pin 162 in the direction towards the control lever 157. On the end of the tilt lever 161 opposite the control pin 162 the lever has a driver pin 163 pointing in the direction towards the ram 140.

The driver pin 163 developed on the tilt lever 161 engages in a U-shaped driver device 164 of a control rod 165. This control rod 165 extends up into the rear region of the attachment machine 1 and is coupled there to a rotary magnet 166.

The arrangement in the embodiment shown is such that the feed rail 16 feeds a button bottom part 67 of a button to the rivet part 60 of the lower tool holder 49 while the feed rail 19 feeds a button upper part 124 to the rivet ram 105 of the upper tool holder 50. The feeding via the rails 17 and 18 of the button parts for the rivet ram 106 and the rivet part 61 is blocked in this connection. From FIG. 16 it can be noted that the button upper part 124 is a cap developed as holding part and that the button lower part 67 is an eye developed as a functional part. Together the two parts form the parts of a snap fastener which are to engage in each other.

The following manner of operation results:

After the insertion of material 167 into the U-shaped free space F of the carriage 30, the material 167 is so aligned that the place of the material at which it is to be provided with a button, rivet or the like is along the extension of the longitudinal axis of the ram 140. If the pedal switch 4 of the attachment machine 1 is now actuated, the drive drives the drive shaft 22 so that the latter carries out a revolution. In this connection, the ram cam disk 24, the auxiliary control cam disk 25, the carriage control cam disk 26 and the finger guard cam disk 27 are also turned.

Figure 13:
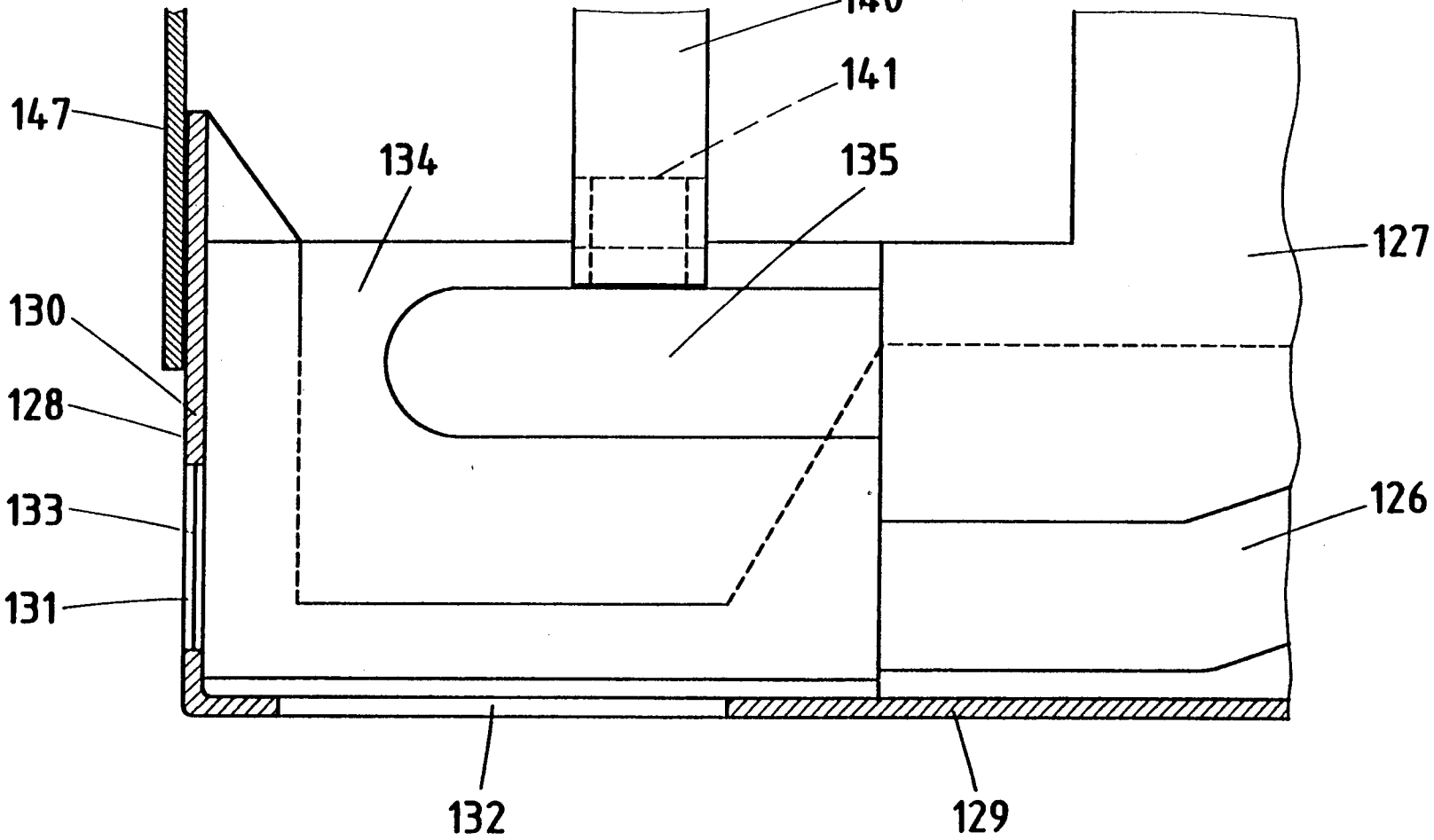
FIG. 13 is a longitudinal section in the region of a clamping surface lying on the upper-tool side and of the coupling region of the ram.
Figure 14:
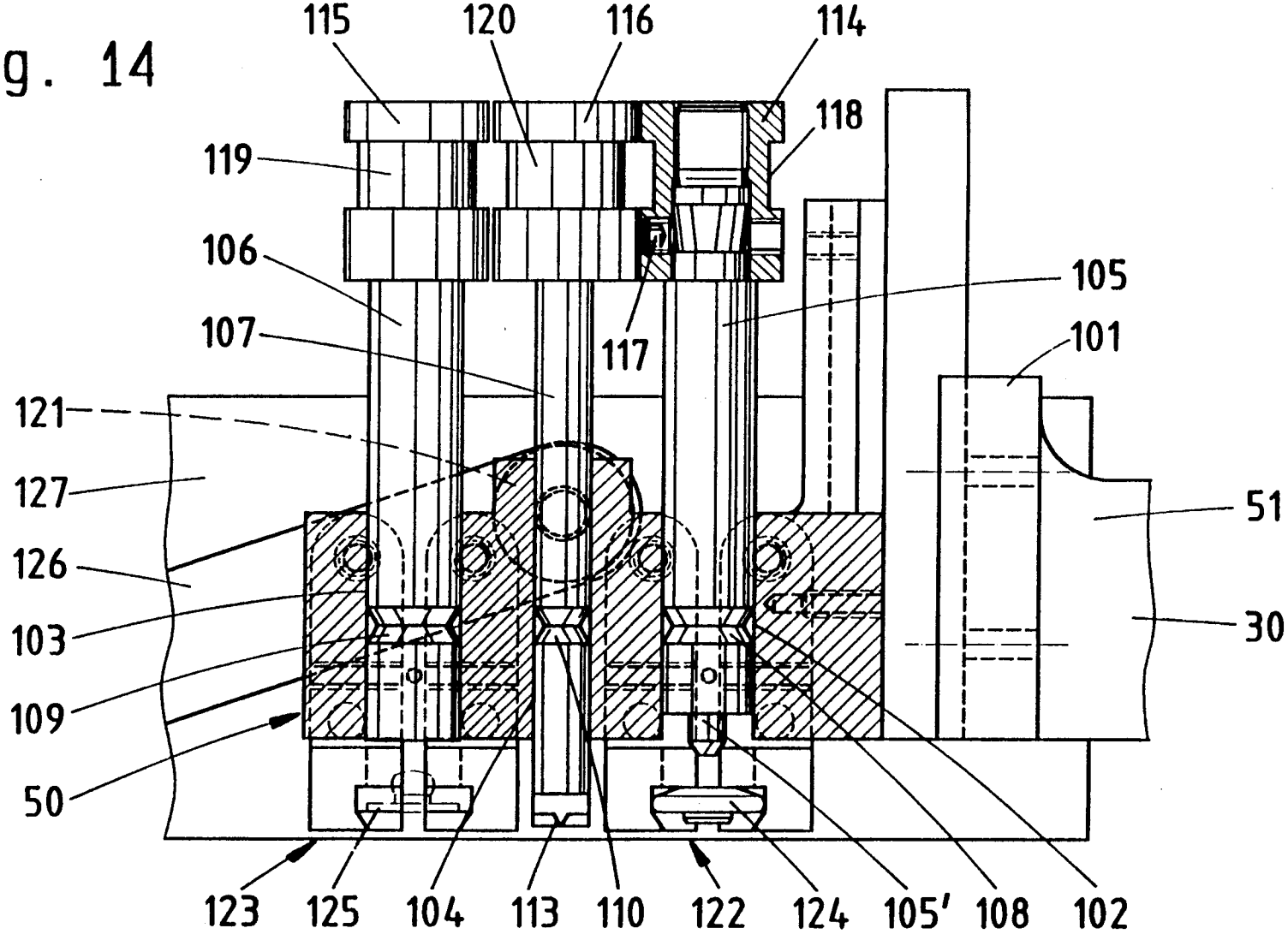
FIG. 14 is a longitudinal section in the region of the upper tool.
Figure 36:
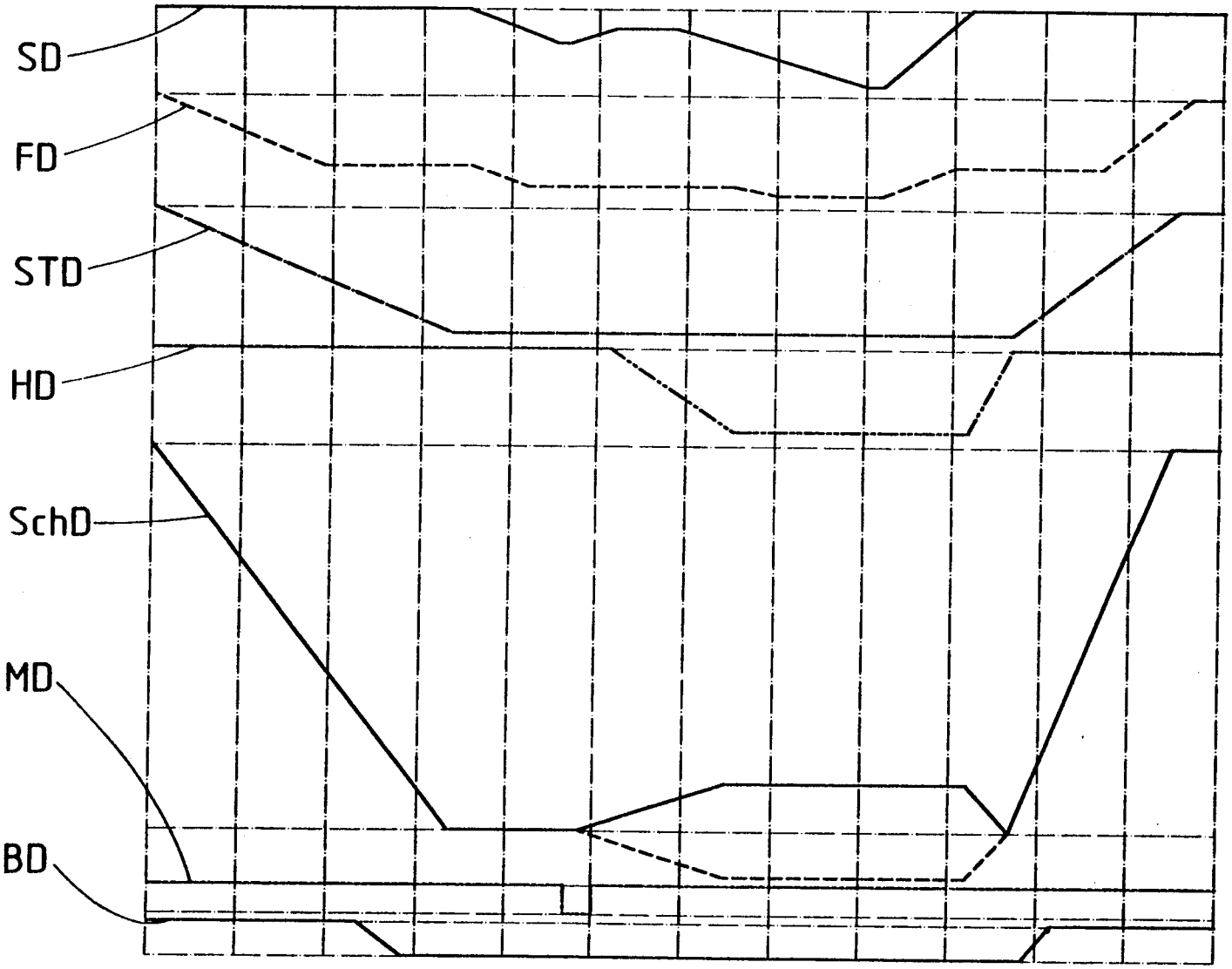
FIG. 36 is an operating diagram of the individual program-controlled parts.

The control times and control paths of the individual rams, of the carriage 30, of the rotary magnet 166, and of the platform 85 are shown in several diagrams in FIG. 36. The diagram for the ram 140 is designated SD and the diagram for the push rod 137 which displaces the finger guard hood 128 is designated FD. The pushing movement of the lever 28 is shown in the diagram STD. The control for the control lever 157 is designated HD. The displacement movements of the carriage 30 can be noted from diagram SchD. Finally, FIG. 13 shows an impulse diagram MD for the rotary magnet 166 and a diagram BD for the front platform 85. In all diagrams there is a 30° graduation of the x-axis.

Figure 18:
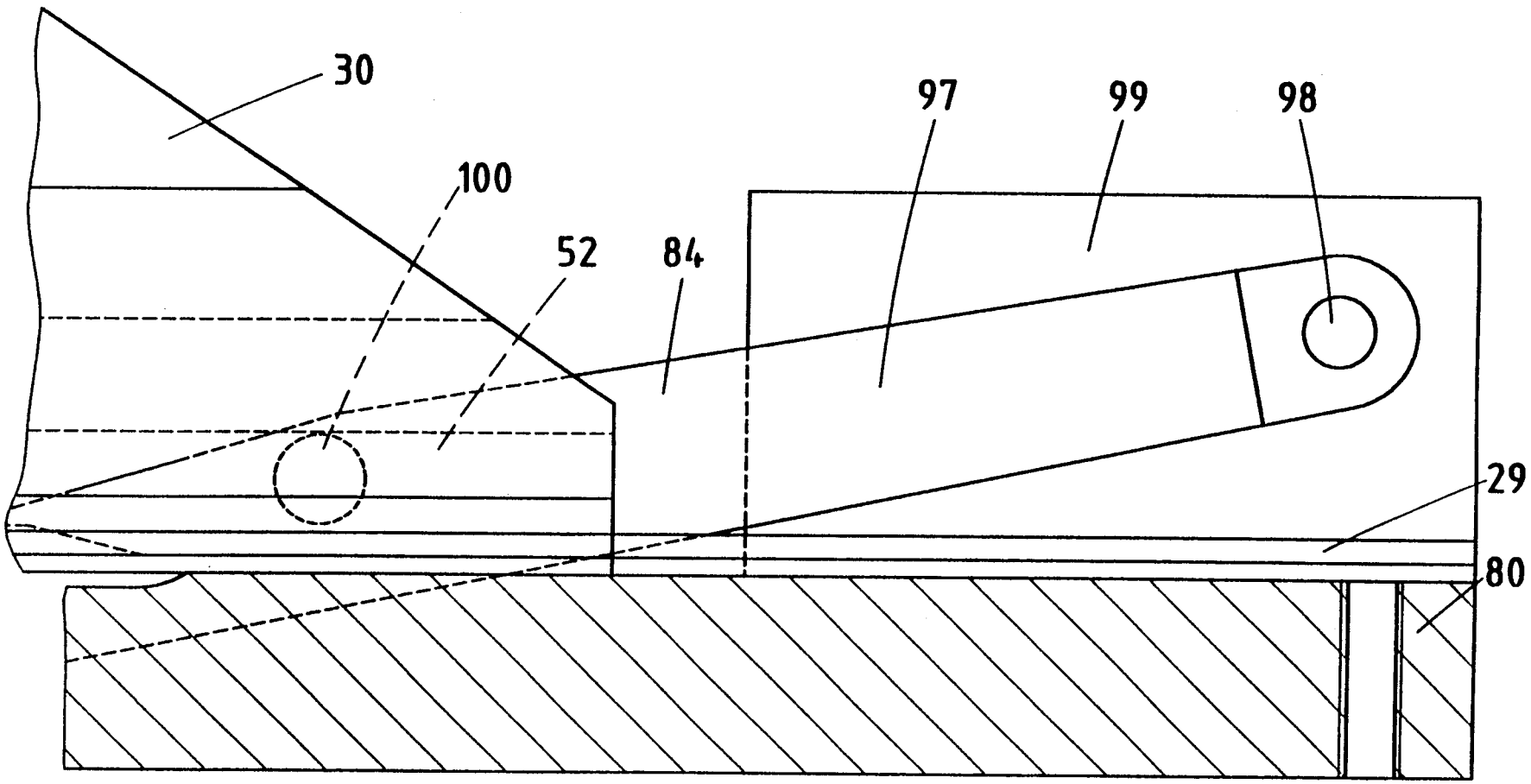
FIG. 18 is a showing which corresponds to FIG. 15, but in this case the carriage has moved so far forward that the swing arm has come into a position of release.
Figure 19:
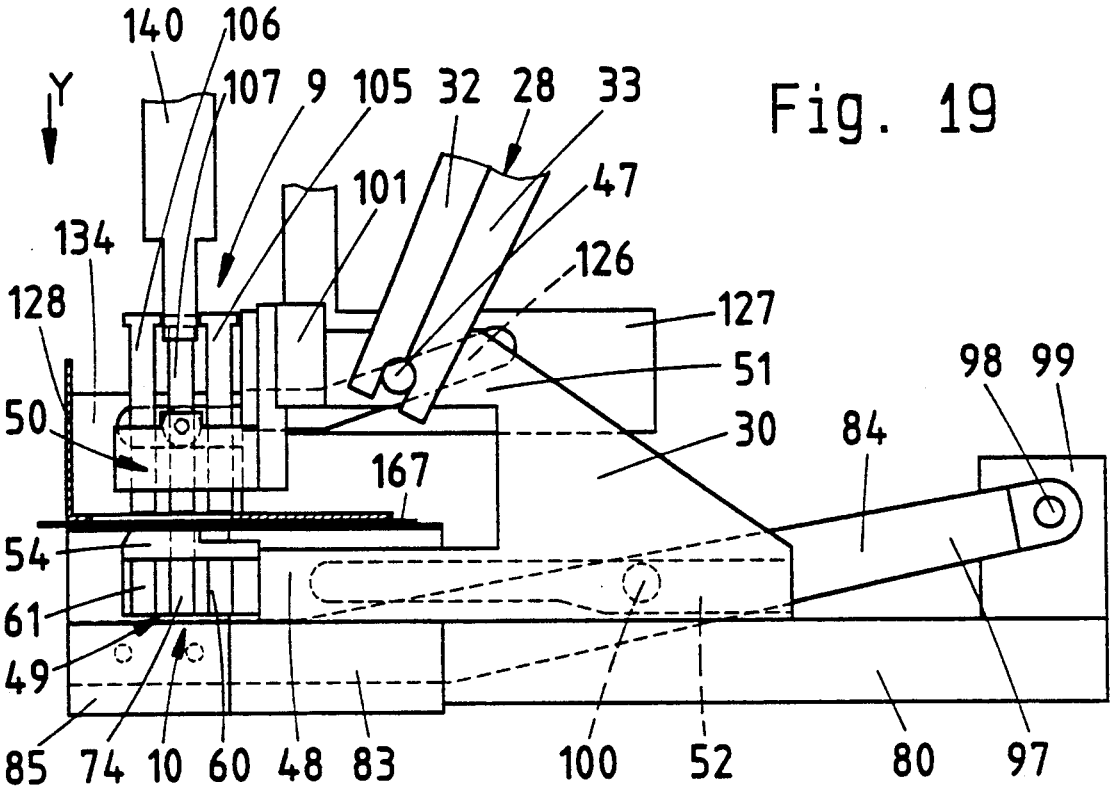
FIG. 19 is a subsequent showing after FIG. 7 in which the clamping surface on the upper-tool side and the upper tool with the ram coupled to the piercing ram is so lowered that an inserted material is held immovable between the clamping surfaces on the upper tool side and on the lower tool side.
Figure 20:
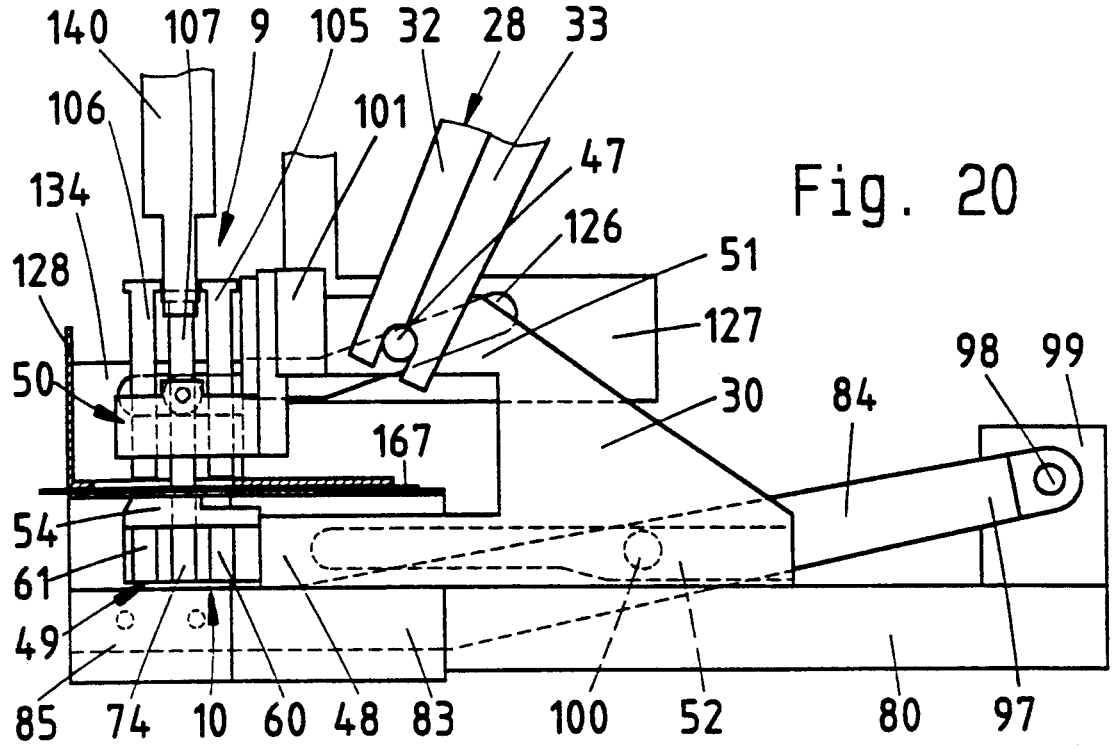
FIG. 20 is a subsequent showing of FIG. 19 concerning the piercing of the material.

As a result of the rotation of the drive shaft 22, the lever 28 is swung around its shaft 35 via the carriage control cam disk 26. This results in forward displacement of the carriage 30 in the direction indicated by the arrow x. This displacement goes hand in hand with a vertical displacement of the upper tool holder 50 which is positively controlled by the oblique-slot guide 126. At the same time as the displacement of the carriage 30 there is a downward displacement of the push rod 137 and thus also of the finger guard hood 128. The finger guard scanning height of about 5 mm between the U-web 129 of the finger guard hood 128 which serves as clamping surface and the working surfaces 92, 94, of the protective hood 83 and of the platform 85 is reached upon a rotation of the drive shaft of about 55°. After this partial rotation the lever 28 has not yet reached its final swing point, which has the positive result that an emergency release is effected by an object of more than 5 mm present between the clamping surfaces still before the first operating position of the carriage 30 is reached. Since the swing arm 85 which, via its guide roller 100, rests in the slot 52 of the carriage 30 has not yet been released here, a lowering of the platform 85 is prevented (see FIG. 18).

The slot 135 of the guide 134 on the finger guard hood 128 lies at this time parallel to the extension of the oblique slot guide 126 of the guide plate 127 and thus forms an extension of the oblique slot guide 126.

Figure 7:
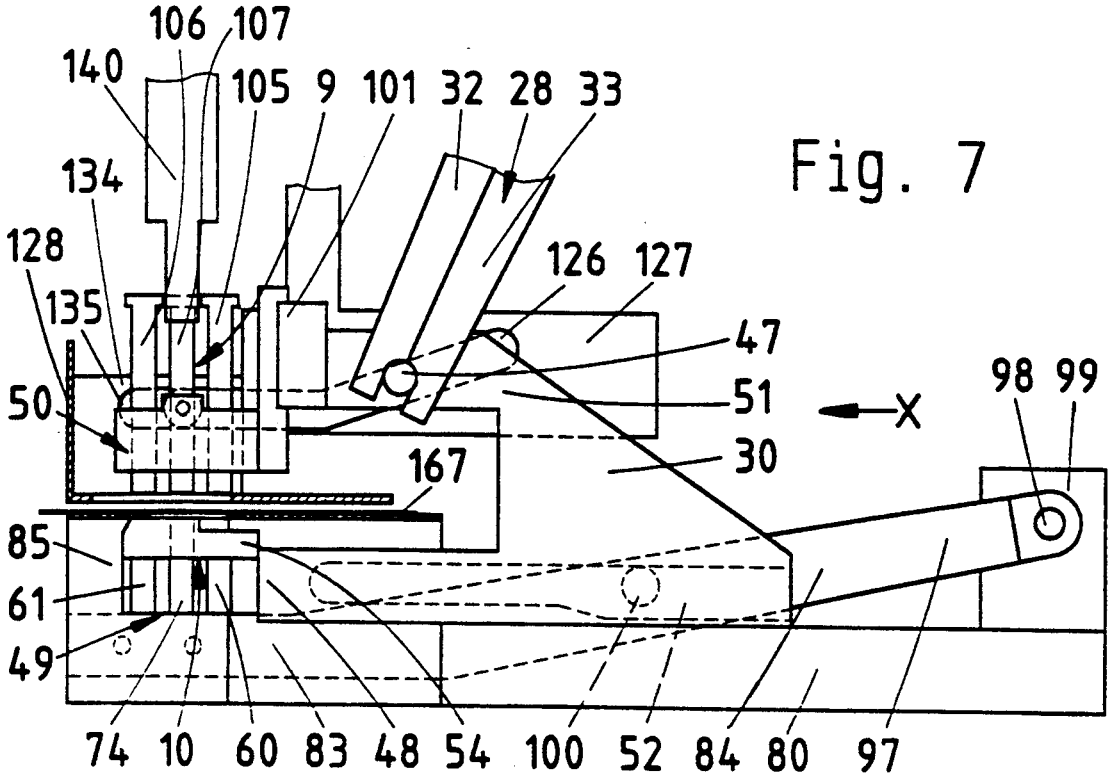
FIG. 7 is a diagram similar to FIG. 6 but after completion of the first path of displacement of the carriage, a piercing ram of the upper tool having entered into coupling position with the ram.
Figures 8, 9:
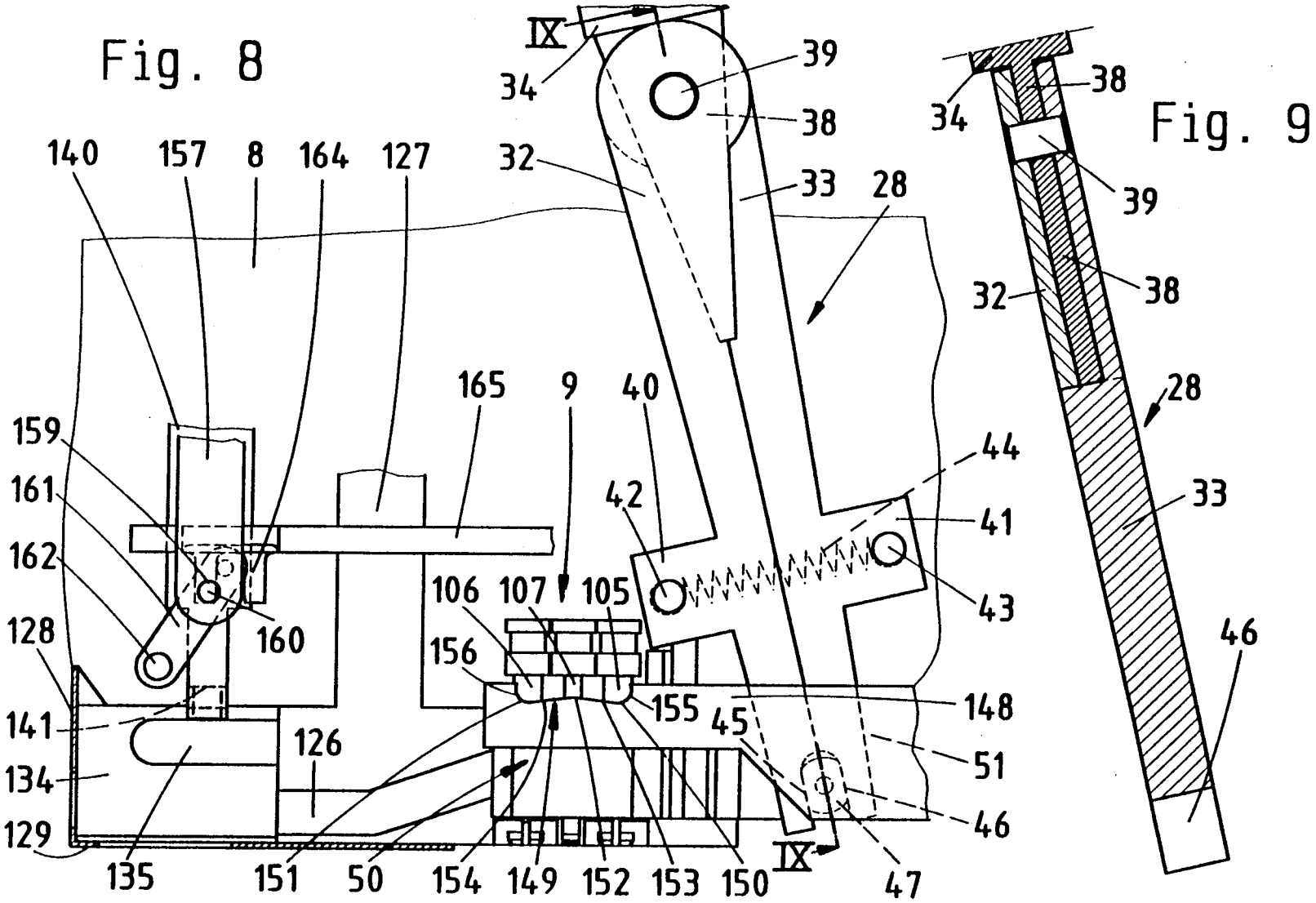
FIG. 8 is an enlarged detail view showing the arrangement of a control lever, a ram, the upper tool and the guidance of this upper tool.
FIG. 9 is a sectional along the line IX—IX in FIG. 8.
Figure 15:
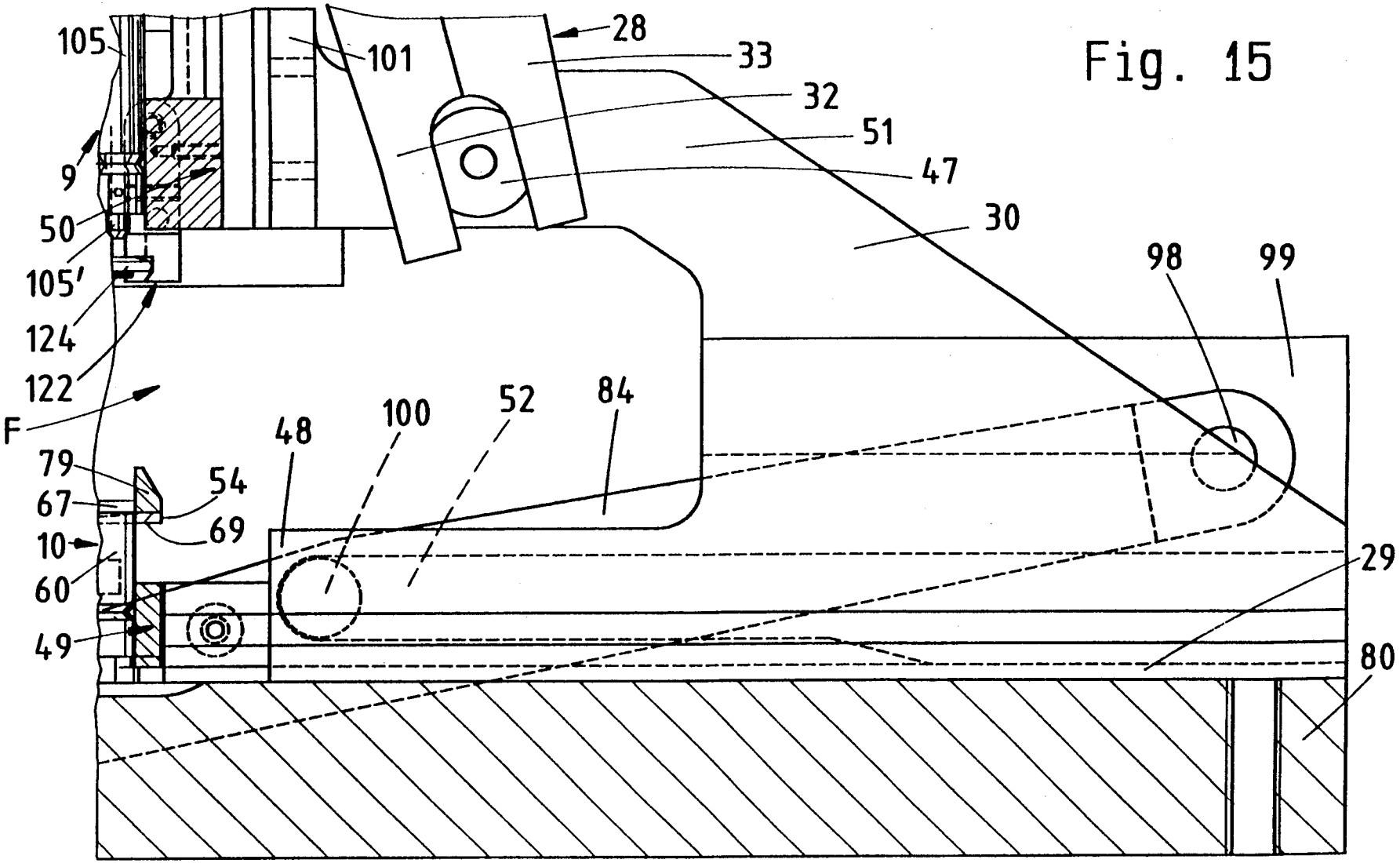
FIG. 15 is an enlarged showing of the U-shaped carriage, a swing arm controlled by this carriage being held in basic position.

The swinging movement of the lever 28 is continued up to a rotation of the drive shaft of about 100°, whereby the upper tool holder 50 advanced via the carriage 30 moves with its roller 121 into the slot 135 in the guide 134. During this process, the rivet ram 106 which is furthest in front in the ram direction passes through the T-shaped coupling extension 141 of the ram 140. After the completion of the swinging of the lever 28, the cylinder receiver 116 of the punch ram 107 has entered the T-shaped coupling shoulder (see FIGS. 7 and 15).

Parallel to the displacement of the upper tool holder 50 in the direction of the arrow x, the lower tool holder 49 also shifts so that in every position the corresponding upper and lower tools are aligned vertically with each other. Upon the advance of the lower tool holder 49 it passes through the protective hood 83 and after the completion of the swinging path of the lever 28 partially enters into the region of the platform 85. In this position, the carriage 30 is advanced so far that the guide roller 100 of the swing arm 84 comes into the widened region of the slot 52 of the carriage 30 (see FIG. 18).

In the further course of the rotation of the drive shaft 22, a further downward displacement of the finger guard hood 128 by means of the push rod 127 and a downward displacement of the ram 140 parallel thereto by about 7 mm takes place upon an angle of rotation of the drive shaft 22 of about 105°. This displacement of finger guard hood 128 and ram 140 effected in the direction indicated by the arrow y is also carried out, due to the resting of the upper tool holder 50 by its roller 121 in the region of the slot 135. In this connection, the upper tool holder 50 is guided in the receiving plate 101 of the carriage 30.

Figure 22:
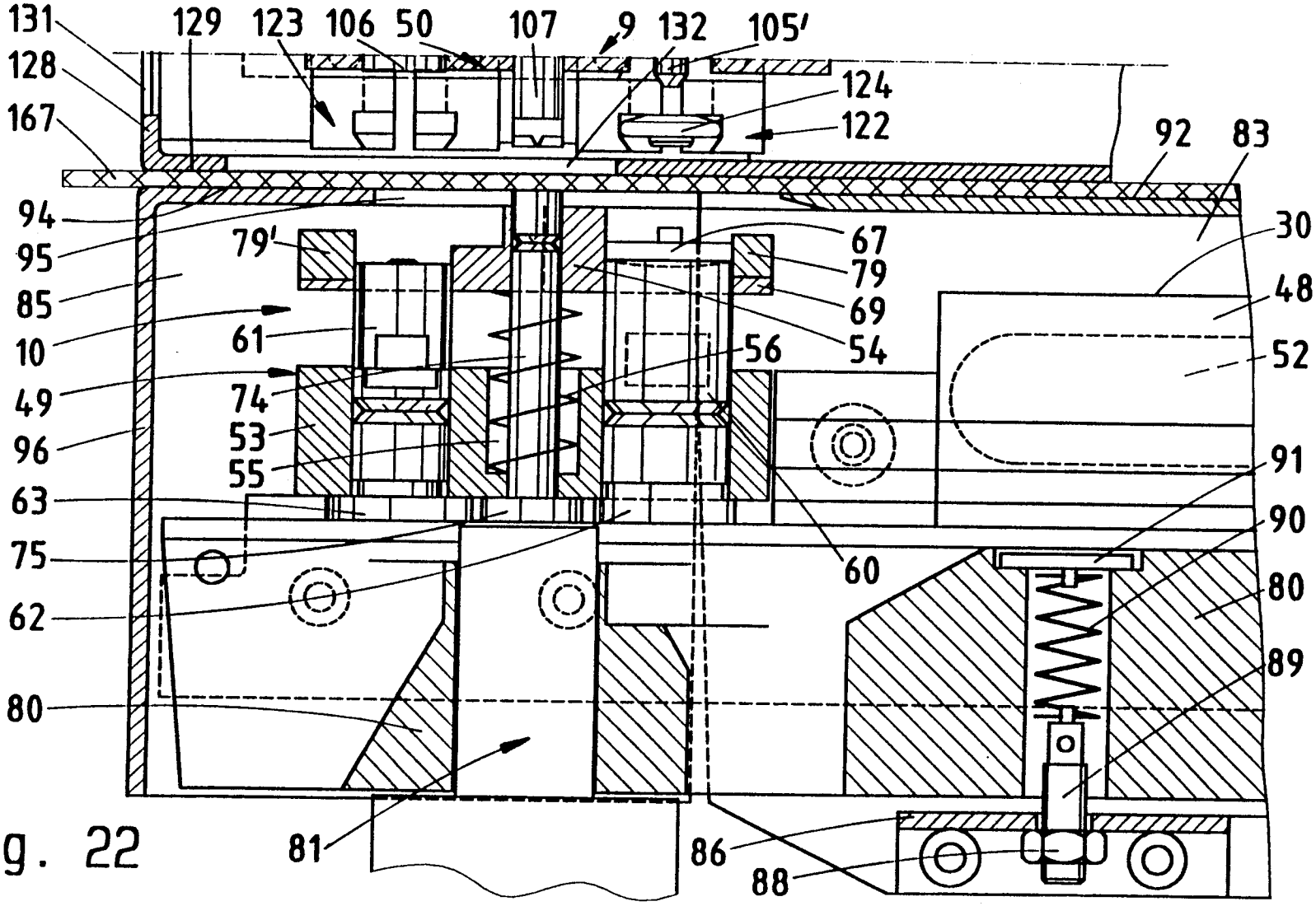
FIG. 22 is a sectional view in the region of the upper and lower tools in accordance with FIG. 19.
Figure 23:
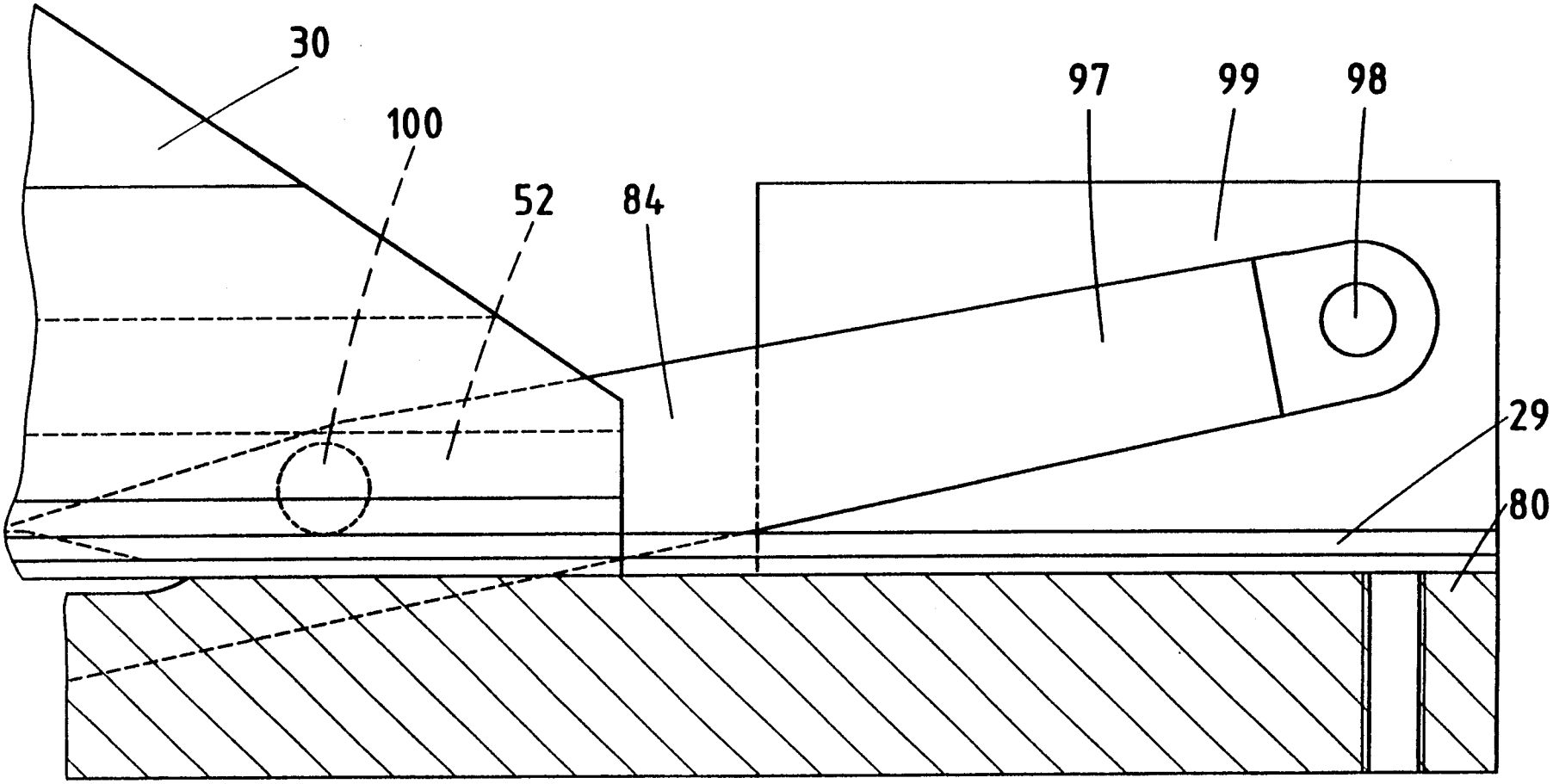
FIG. 23 is a successive showing of FIG. 18, the released arm being swung here.

The downward displacement of the finger guard hood 128 effects by impact a positive displacement of the protective hood 83 and of the platform 85 by about 2 mm. The protective hood 83 is in this connection displaced downward against the force of the tension spring 90. The front platform 85, due to the release of the guide roller 100 of the swing arm 84, can move away in the slot 52 of the carriage 30. In this connection, the platform 85 is acted on in the direction towards the finger guard hood 128 by a spring (not shown). The working surfaces 92, 94, of the protective hood 83 and of the platform 85 and the U-web 129 of the finger guard hood 128 serve as clamping surfaces. FIG. 22 shows the clamped position of the material 167. This clamped position is now retained until the end of the riveting process, so that no slippage of the material 167 is possible.

Immediately after the clamping of the material 167 the piercing commences. For this purpose the ram 140, as a result of the control, travels an additional 5 mm in the direction towards the U-shaped free space F carrying along the punch ram 107. Due to the fact that the finger guard hood 128 retains its position, the upper tool holder 50 is also caught in this position. This has the result that the punch ram 107 leaves the basic position established by the detent ball 112.

Figure 24:
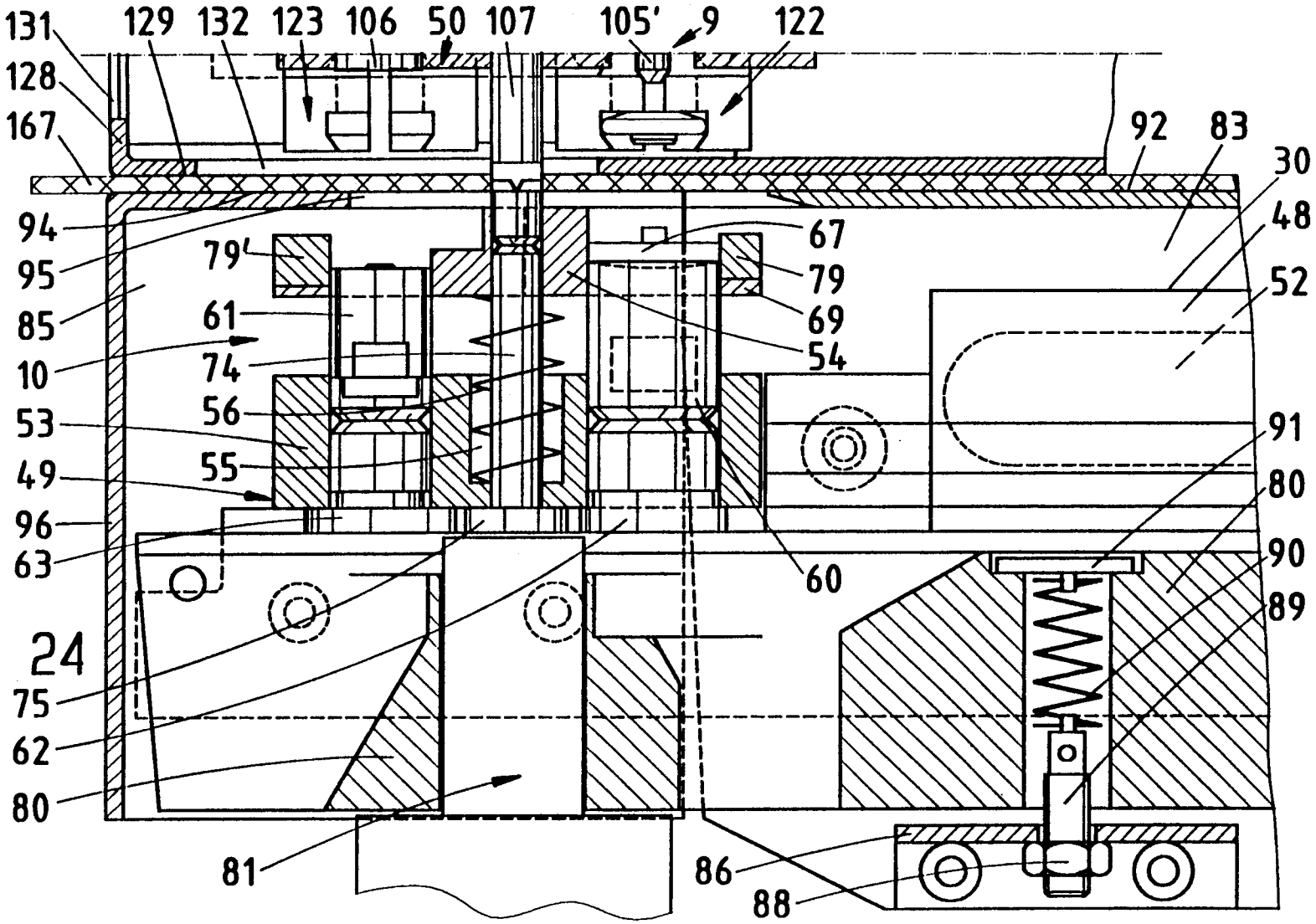
FIG. 24 is a subsequent showing of FIG. 22, concerning the piercing position of the piercing ram.
Figure 25:
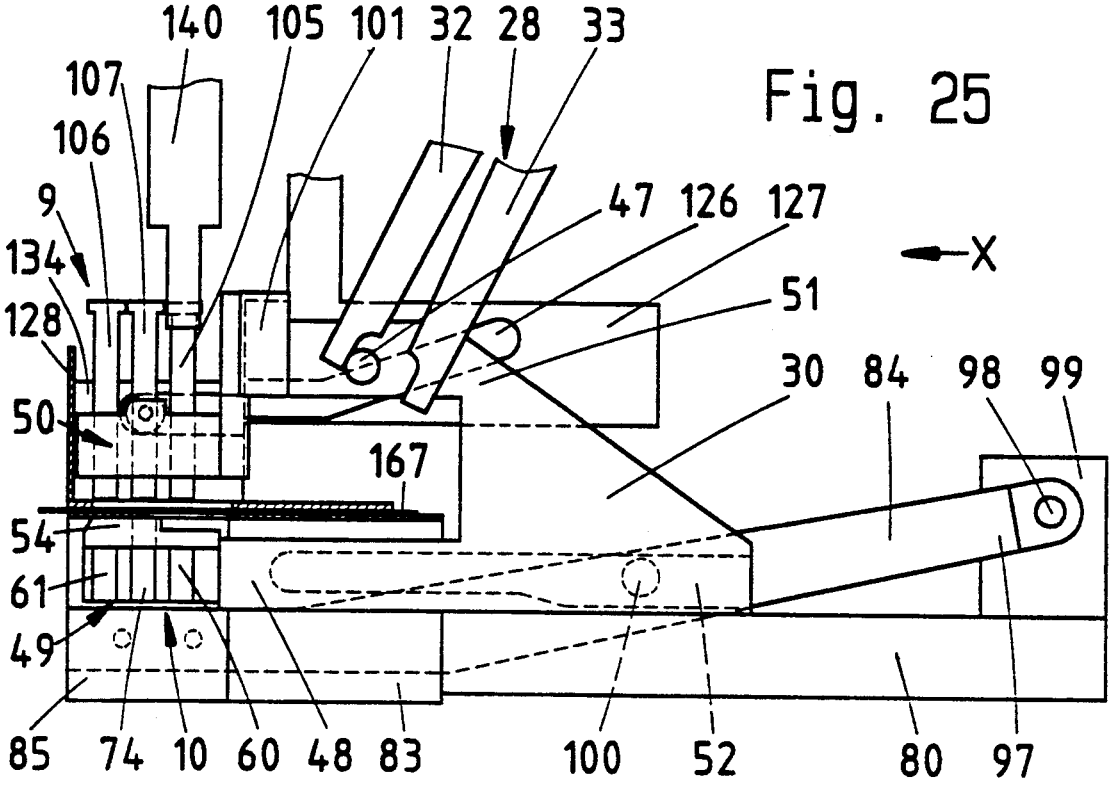
FIG. 25 is a subsequent showing of FIG. 20, the carriage, after completion of a second displacement path, having been so displaced that the ram has entered into a coupling position with an upper tool adjacent to the piercing ram.
Figure 26:
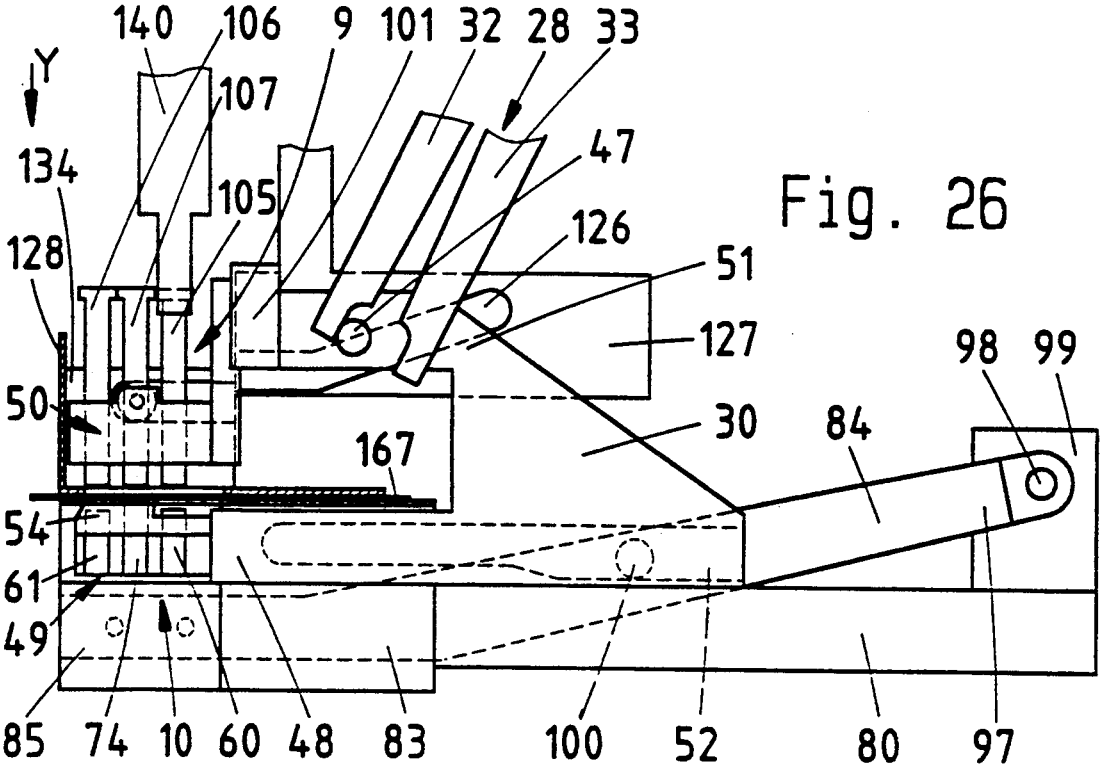
FIG. 26 is a subsequent showing of FIG. 25, in which, however, both the clamping surface on the upper tool side as well as the upper tool have been moved further in the direction towards the clamping surfaces on the lower-tool side.

Upon the piercing process, the hole blade 113 of the punch ram 107 passes through the material 167 under the action of the punch piston 74. By the downward displacement of the front platform 85 which has taken place previously, the receiver 54 of the lower tool holder 49 is moved in the direction towards the anvil ledge 80. The punch piston 74 rests in this process against the pressure equalization device 81 over its entire surface on both pressure cylinder halves and thus loses engagement with the detent ball 77, with the result that the upper end region of the punch piston 74 extends into the slot 95 of the working surface 94. (See FIG. 24).

After the piercing process, the ram 140 moves back into the position in which the punch ram 107 finds its fixed basic position in the upper tool holder 50.

Figure 21:
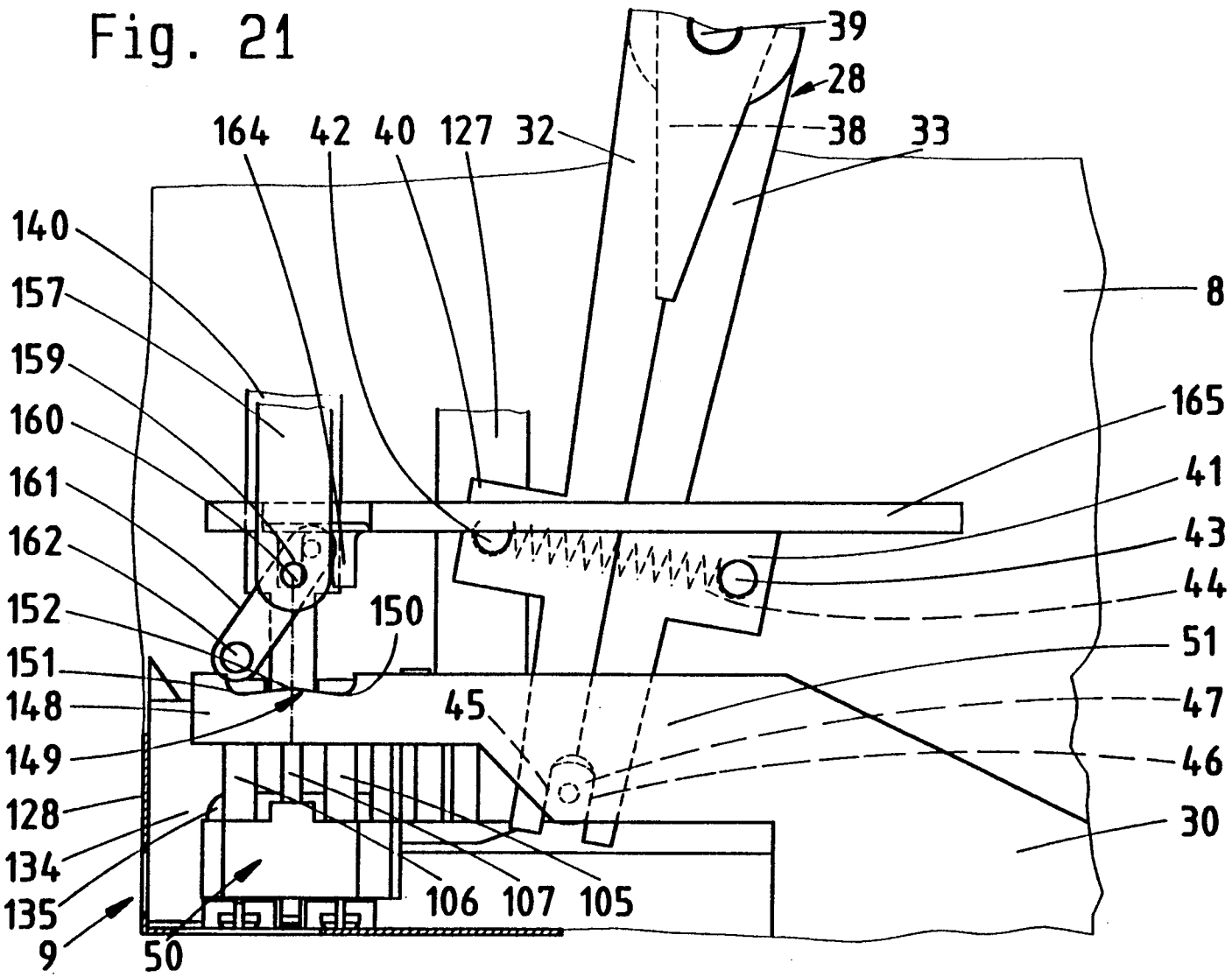
FIG. 21 is a showing corresponding to FIG. 8, but concerning the working position in accordance with FIG. 19.

The control of the carriage cam disk 26 now does not effect any further displacement of the carriage 30. This second path of displacement now takes place by means of the control lever 157, for which purpose a previously program-controlled displacement of the control rod 165 is effected by means of the rotary magnet 166. The control rod 165 is moved forward or backward depending upon what tools have been provided with button parts. This displacement results in a swinging of the tilt lever 161 which is pivoted to the control lever 157. In the embodiment shown in the drawing, the control rod 165 is moved backward by the rotary magnet 166, whereby a turning of the tilt lever 161 takes place in such a manner that the control pin 162 points in the direction towards the cover 147 of the attachment machine 1. As can be noted from FIG. 21, with the carriage 30 advanced, the control pin 162 lies directly over the control section 151 of the control guide 149 in the region of the end of the control arm 148.

During the further course of rotation of the drive shaft 22, there is a downward displacement via the auxiliary control ca disk 25 of the control lever 157 in the direction towards the control arm 148. In this connection, the control pin 162 strikes the control contact surface 156, whereby the carriage 30 is displaced further forward, with simultaneous change of the upper tool. The punch ram 107 now leaves its engagement with the T-shaped coupling extension 141 of the ram 140, into which the cylinder receiver 114 of the rivet ram 105 now enters.

At the same time as the displacement of the upper tool holder 50 there is a parallel displacement of the lower tool holder 49, the rivet part 60 coming into position opposite the rivet ram 105.

Figure 27:
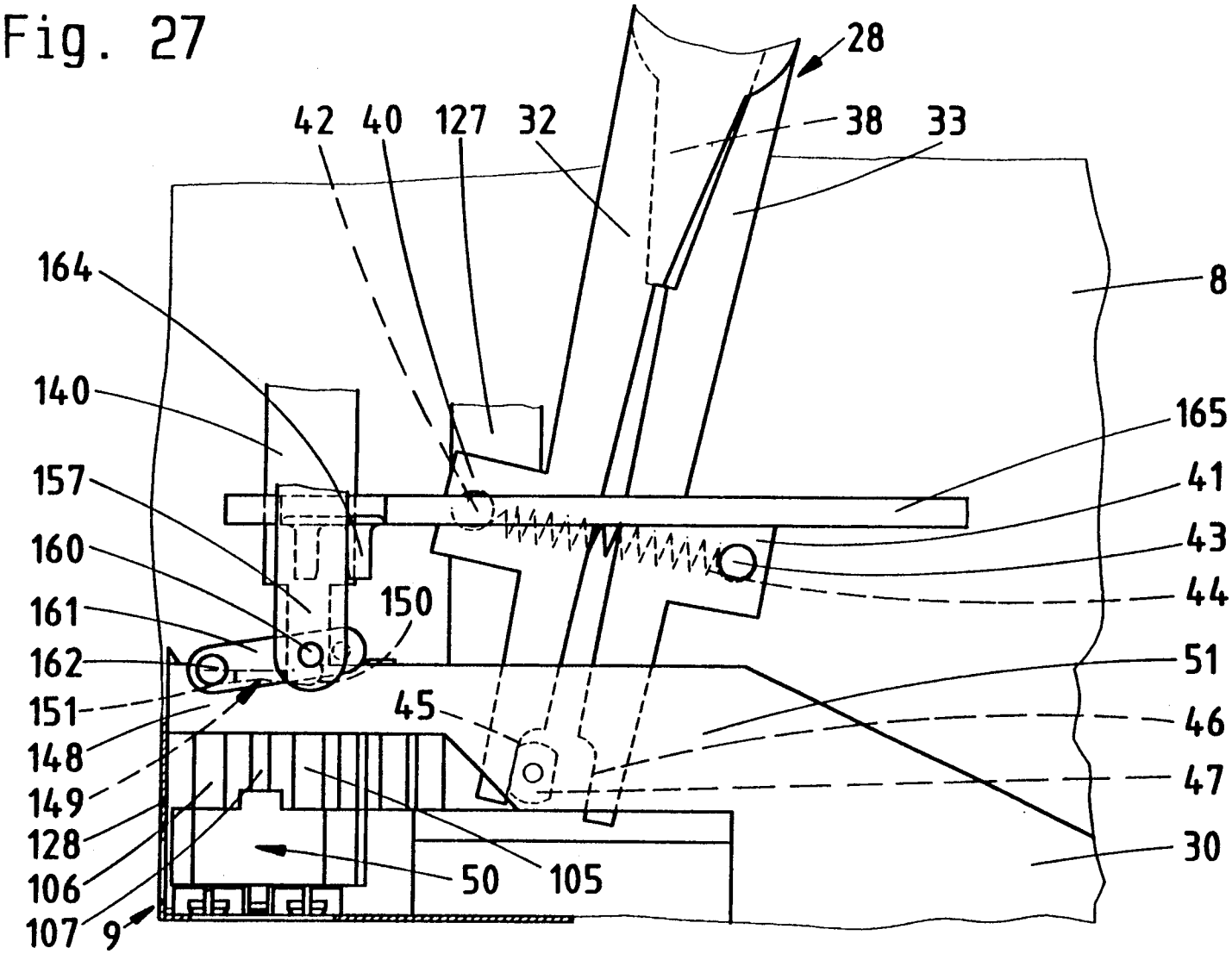
FIG. 27 is a subsequent showing of FIG. 21 according to FIG. 25.
Figure 28:
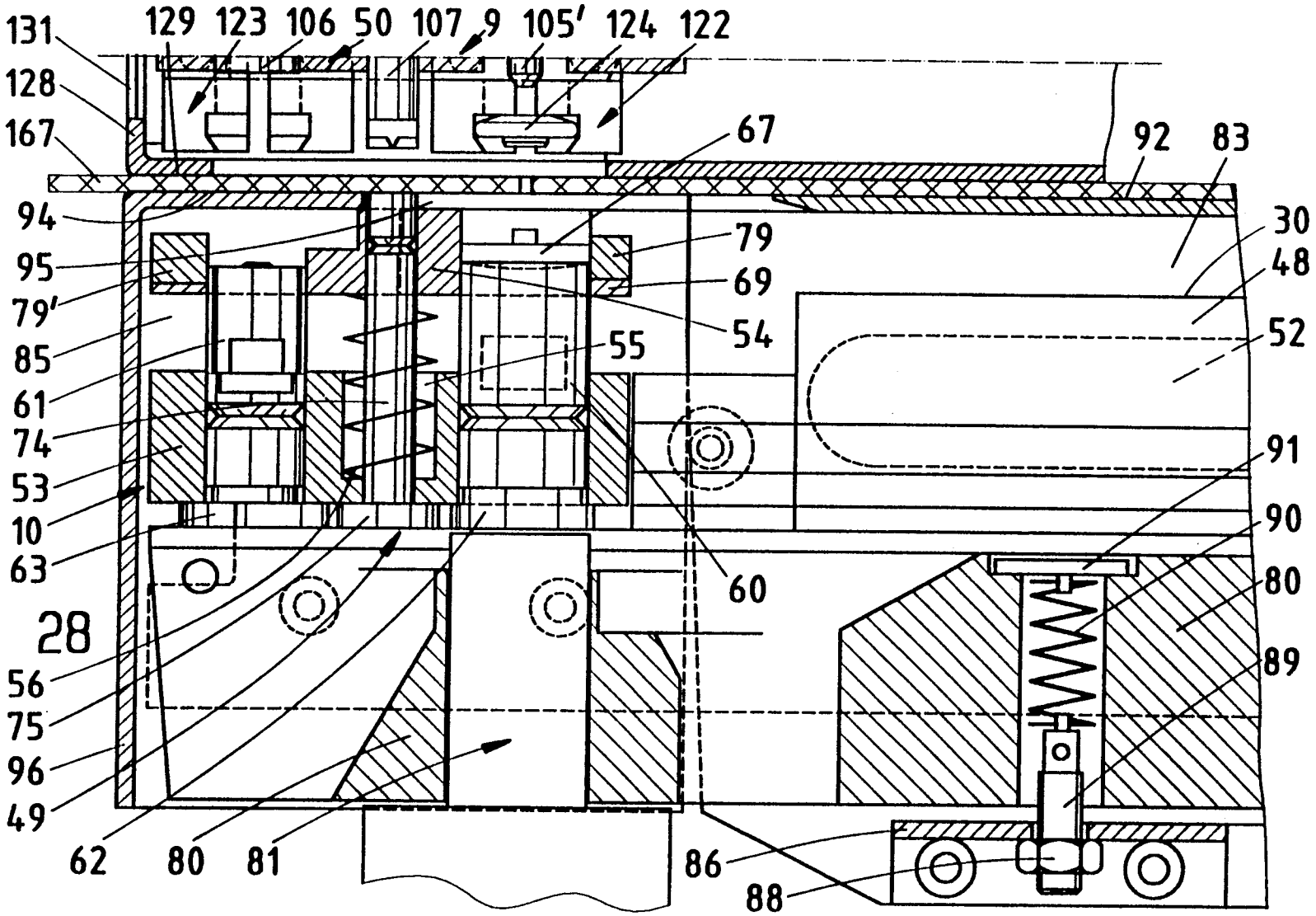
FIG. 28 is a sectional showing in the region of the upper and lower tools according to FIG. 25.
Figure 29:
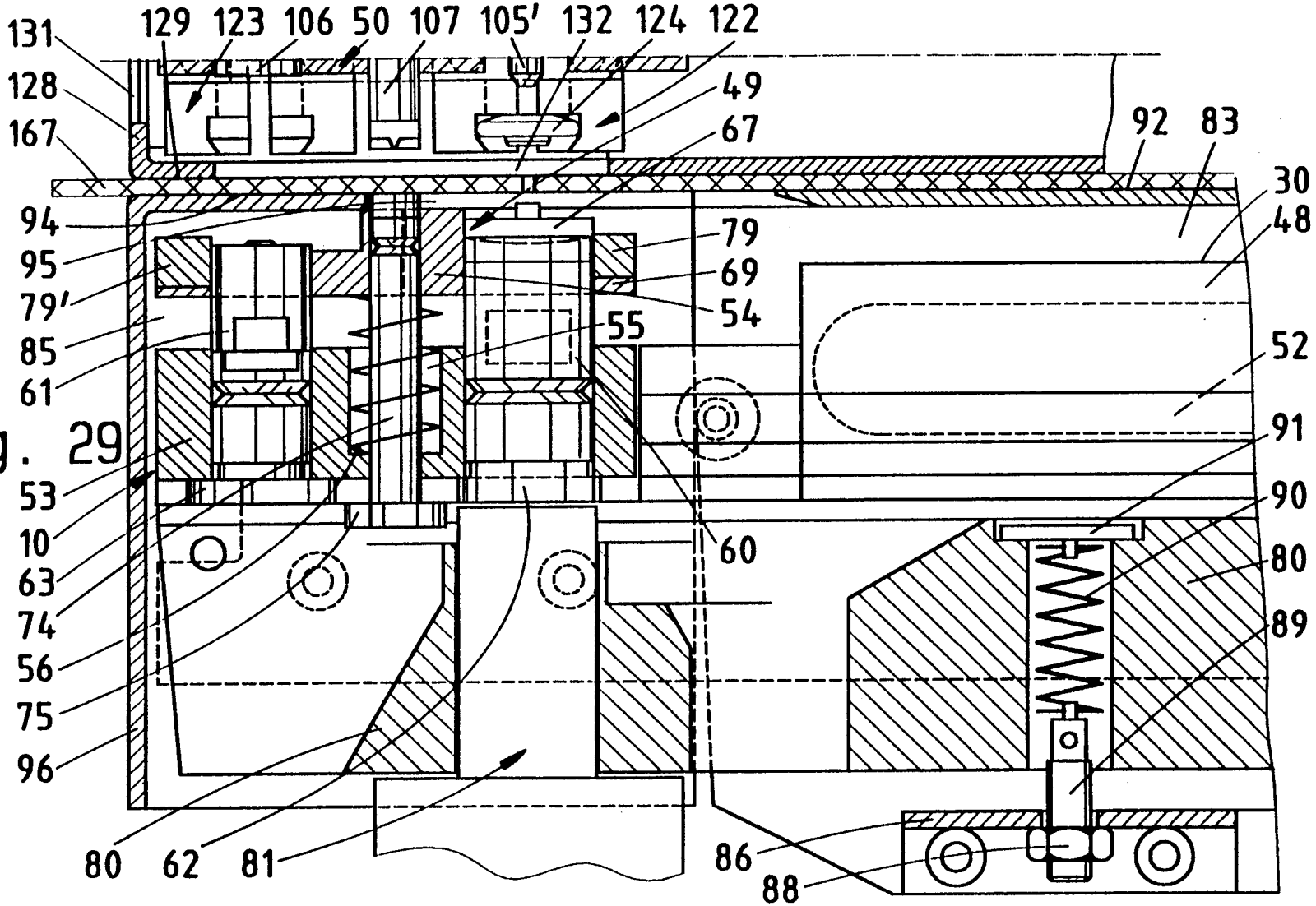
FIG. 29 is a subsequent showing of FIG. 28, according to FIG. 26.
Figure 30:
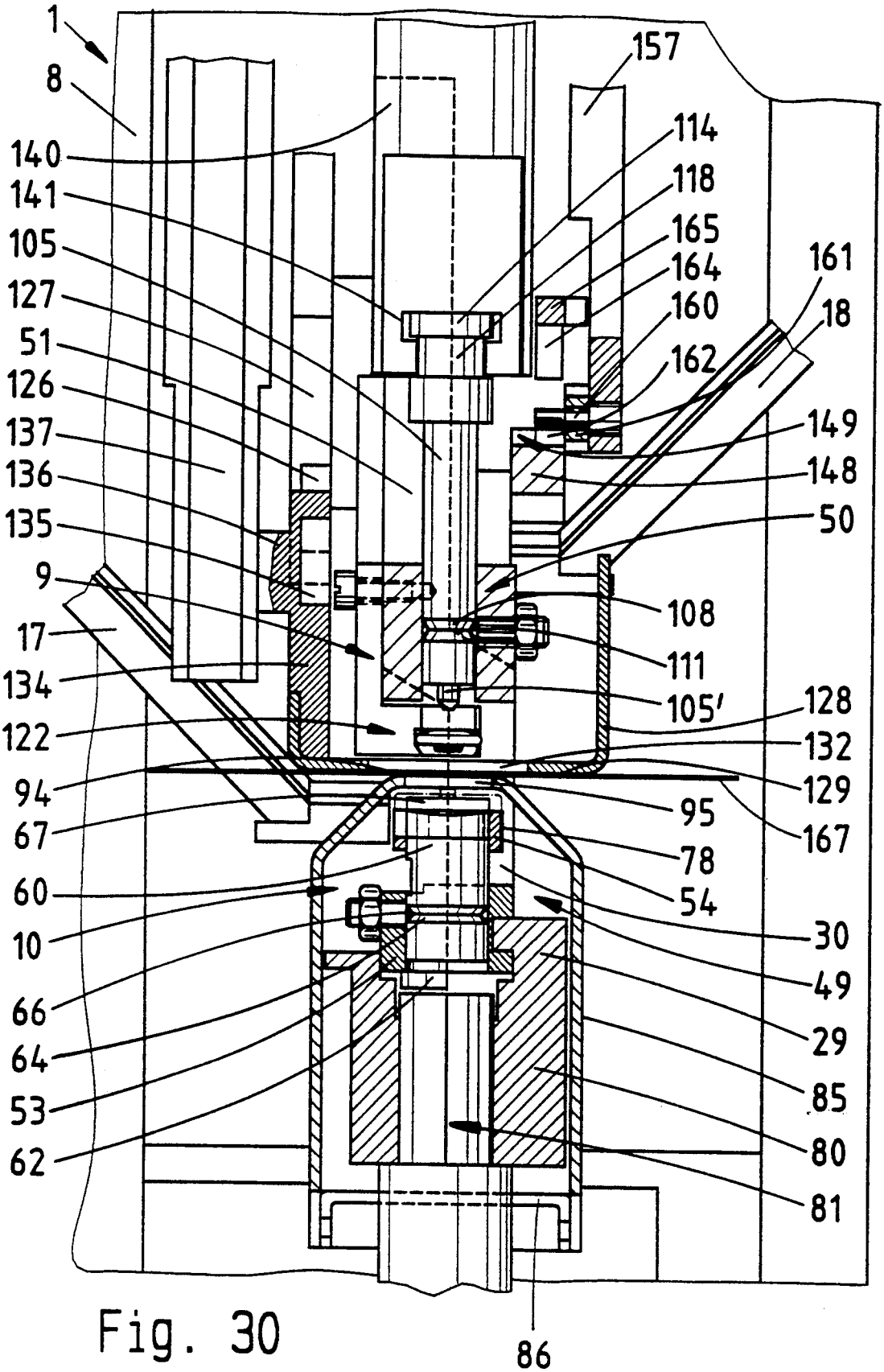
FIG. 30 is a sectional showing in the region of the upper and lower tools according to FIG. 26.
Figure 31:
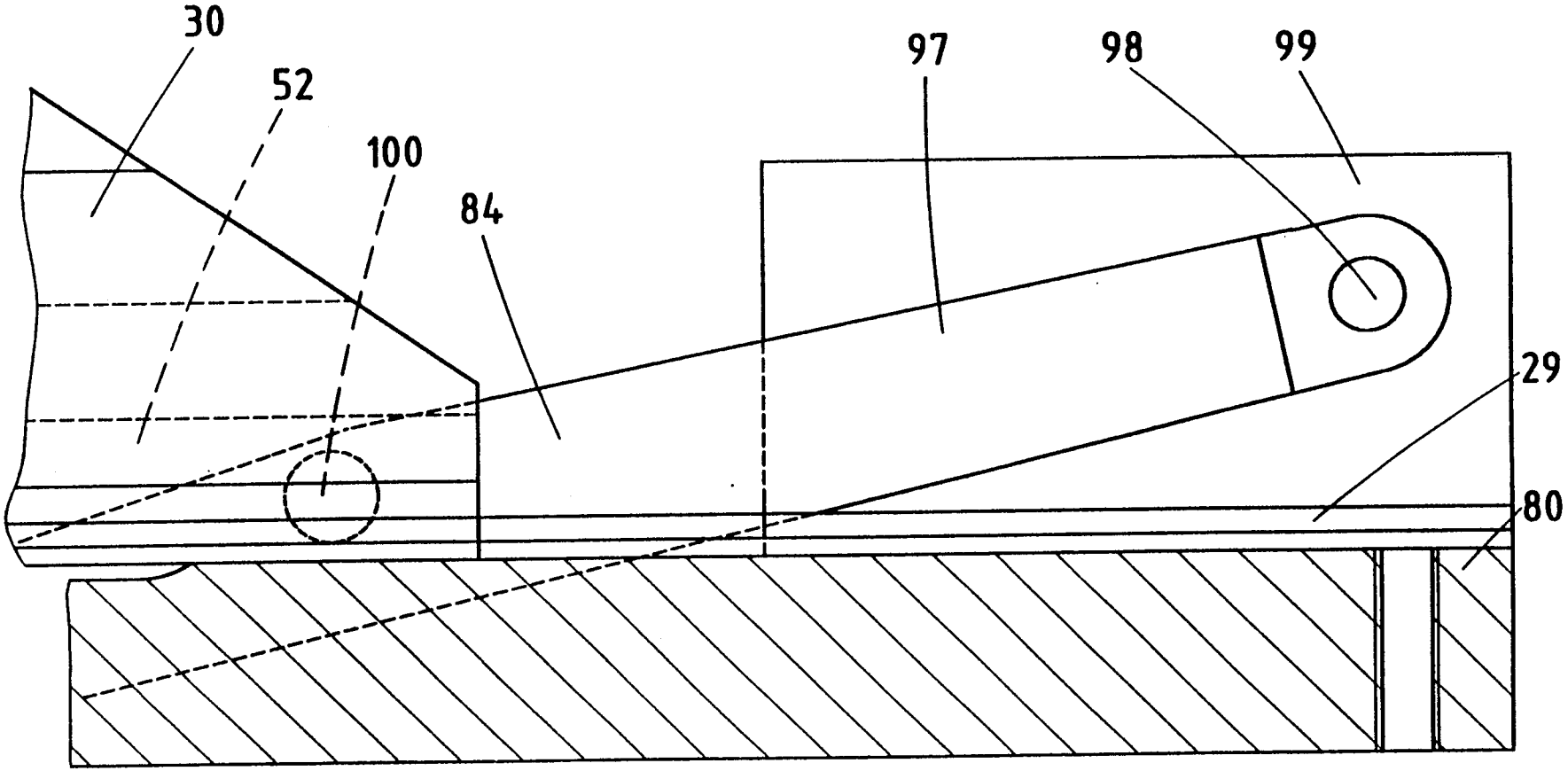
FIG. 31 is a subsequent showing of FIG. 23, the arm having been swung into its end position.
Figure 32:
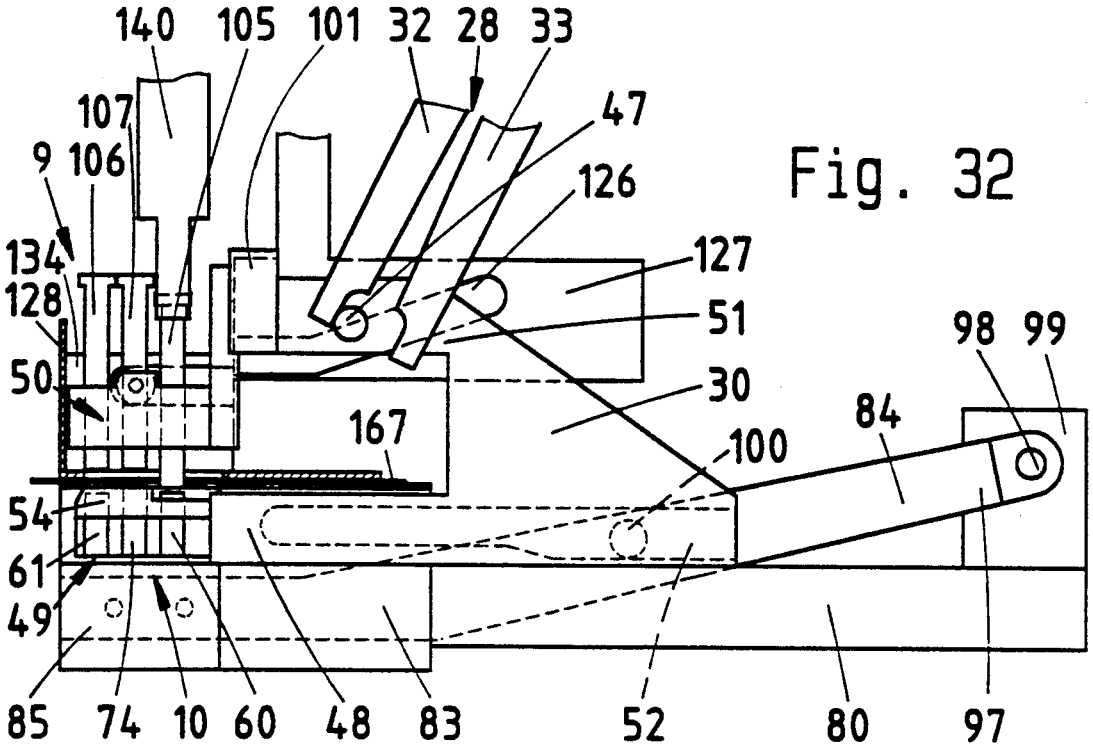
FIG. 32 is a subsequent showing of FIG. 26 in which the riveting of the head parts of the corresponding upper and lower tools is shown.
Figure 33:
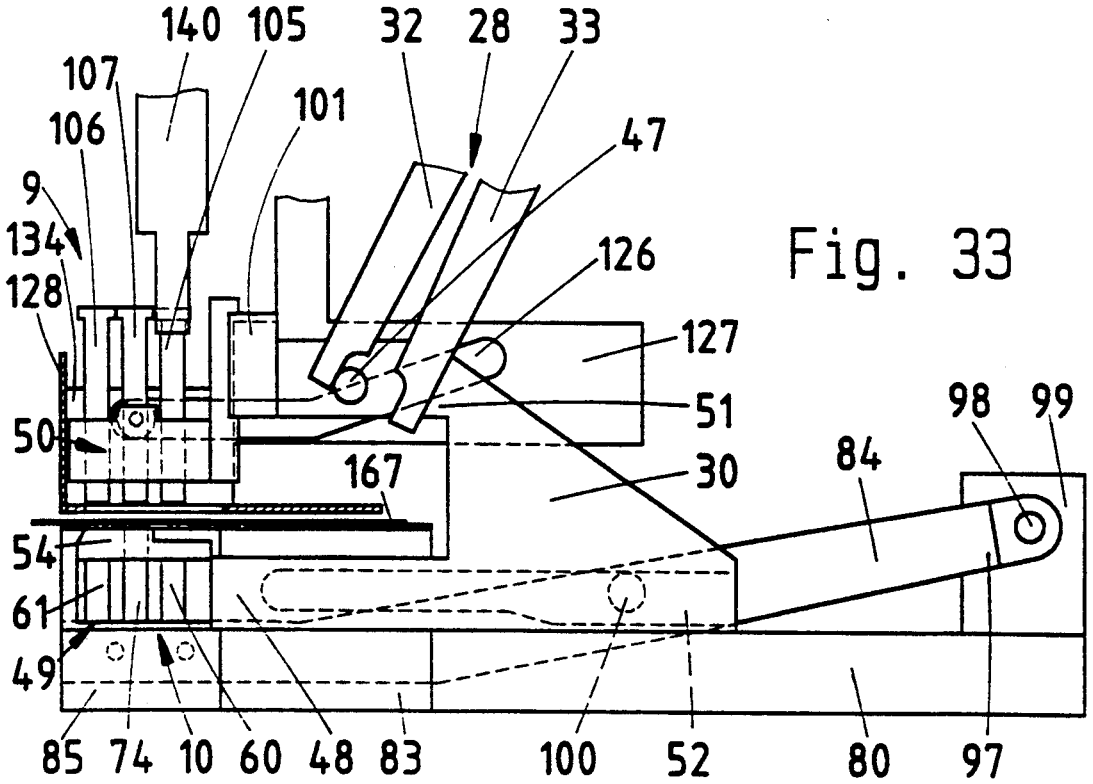
FIG. 33 is a subsequent showing of FIG. 32 in which both the clamping surface on the upper tool side and the upper tool are moved back while maintaining a finger-guard distance between the clamping surfaces on the upper tool side and on the lower tool side.
Figure 34:
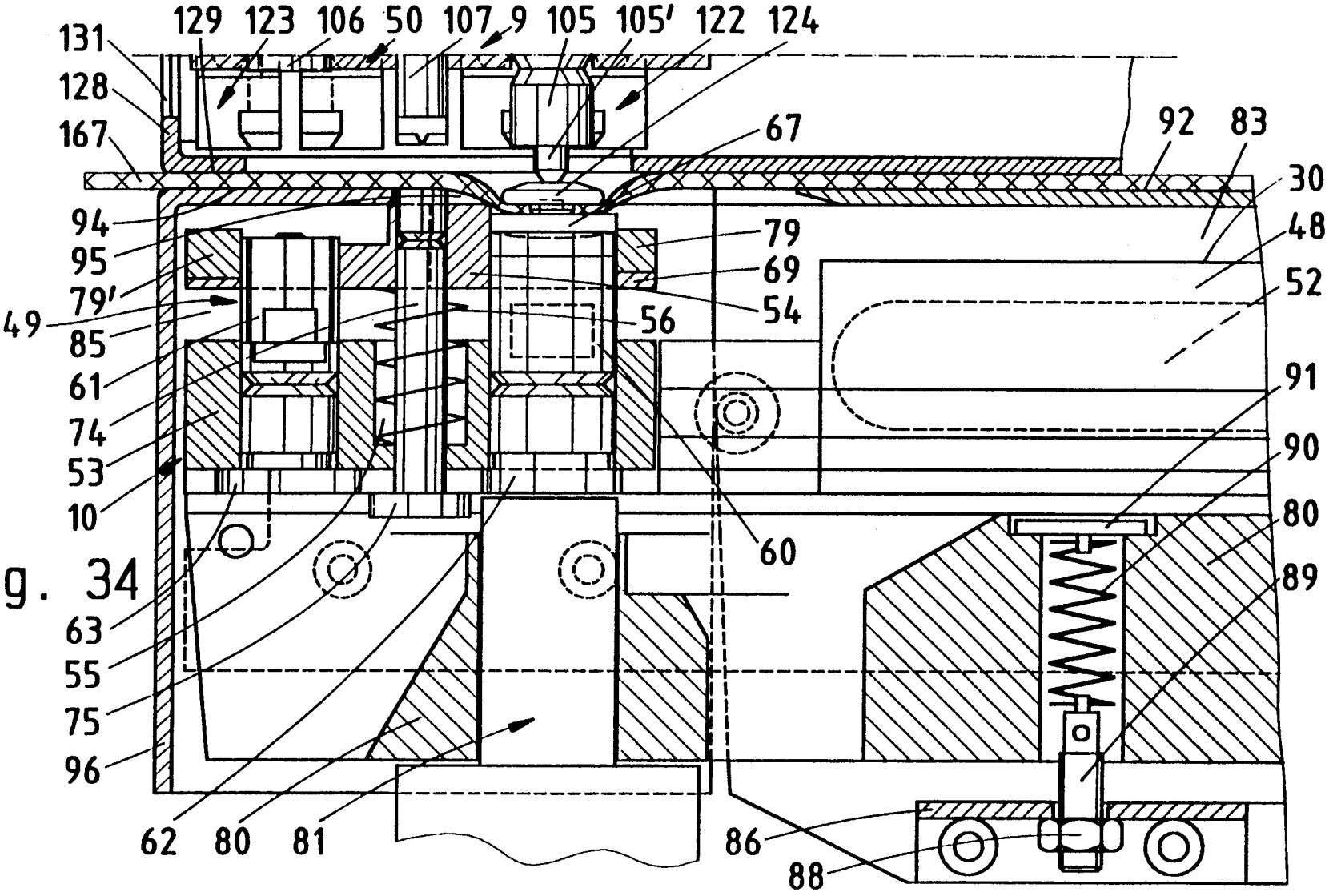
FIG. 34 is a subsequent showing of FIG. 29 according to FIG. 32.
Figure 35:
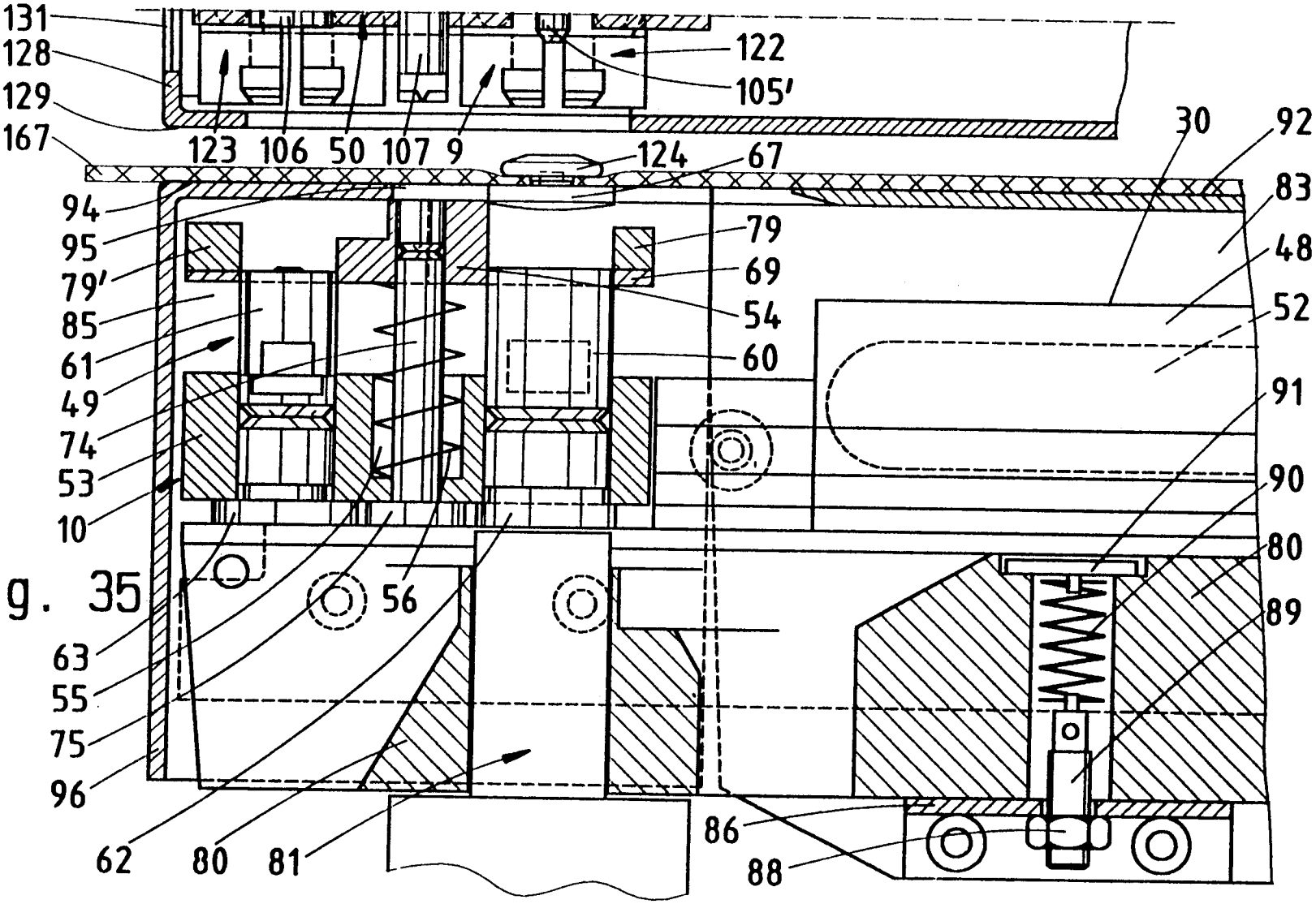
FIG. 35 is a sectional showing according to FIG. 34, but concerning the retracted position in accordance with FIG. 33.

The further displacement of the carriage 30, in view of the rigid position of the elbow lever 31 of the lever 28, results in a scissor-like opening of the swing arms 32, 33. The swing arm 32 is carried along by the transmission pin 47 of the carriage 30, the swing arm 33 resting, in opposition to the spring force of the tension spring 44, against the wedge-shaped extension 38 of the elbow lever 31 (see FIG. 27).

After an angle of rotation of the drive shaft 22 of 195° there is a further lowering of finger guard hood 128 and ram 140 together with a displacement parallel thereto of the upper tool holder 50. This results in a further positively controlled lowering of the platform 85 and the protective hood 83.

The riveting process is now carried out. For this, the ram 140 is moved via the ram cam disk 24 in the direction towards the anvil strip 80, carrying along the rivet ram 105 which has entered into the T-shaped coupling shoulder 141. While this is taking place, the dome 105' acts on the button top part 14 which, with swinging of the pair of tongs 122, leaves the clamping seat in said pair of tongs 122. Due to the fact that the material 167 is still clamped in position, the riveting of button top part 124 and bottom lower part 67 takes place precisely at the point where the hole was previously made. Upon the riveting, the shoulder 62 of the rivet part 60 rests against one of the two cylinder halves of the pressure equalization device 81.

Since the shoulders 62 and 63 of the rivet parts 60 and 61 are of semicircular shape and are aligned offset to each other, one or the other cylinder half of the pressure equalization device 81 is used after use of the one or the other rivet part 60 or 61. The pressure in these individual cylinder halves can accordingly be adapted differently, in accordance with the requirements.

After the riveting of button top part 124 and lower part 67, the rivet ram 105 is moved by means of the ram 140 back into its basic position in the upper tool holder 50. The detent ball 111 thus passes again into engagement with the constriction 108 in the rivet ram 105.

The finger guard hood 128 is then again moved back to the finger guard scanning height of about 5 mm, the ram 140 being brought at the same time into its basic position. After the movement of the control lever 157 back into its starting position, the positively controlled backward movement of the carriage 30 takes place via the lever 28, the finger-guard scanning being eliminated only shortly before the end position of the carriage 30 is reached.

Another button, rivet or the like can now be attached, in which connection, under program control, the rivet ram 106 and the rivet part 61 associated with it can this time also be used.

During a 360° rotation of the drive shaft 22, there are thus effected a punching of the material 167 and attachment of a rivet or the like at precisely the same place where the hole was previously formed, the clamped position of the material 167 being eliminated between the punching process and the riveting process.

We claim:

1. A machine for attachment of buttons or rivets to material of articles of clothing, wherein each button or rivet comprises an upper part and a lower part, the machine comprising:

a plurality of upper tools, a plurality of lower tools, a ram operatively coupled to individual ones of said upper tools and said lower tools, a first magazine and a second magazine for storing respectively the upper parts and the lower parts of a plurality of buttons or rivets;

wherein an upper part carried by an upper tool and a lower part carried by a lower tool are brought by a stroke of said ram at a location in said material into form-locked connection with each other;

the machine further comprises a carriage which is displaceable forward and backward relative to a position of attachment of a button or a rivet to the material, said carriage being of U-shape and having a first arm and a second arm pointing in a direction of advance of the carriage toward the attachment position;

wherein said upper tools are arranged in a row on said first arm, and said lower tools are arranged in a row on said second arm, said upper tools facing said lower tools; and each of said upper tools has a head part for engagement with said ram upon a positioning of said carriage in a position of coupling engagement of one of said upper tools with said ram.

2. A machine according to claim 1, wherein there are three of said upper tools arranged in said row of upper tools including a piercing tool located in the middle of said row of upper tools.

3. A machine according to claim 1, wherein said carriage defines a U-shaped free space between said first arm and said second arm, the machine further comprising a plurality of clamping surfaces arranged below said ram for clamping the material at a height of the U-shaped free space of the carriage.

4. A machine according to claim 3, further comprising means for urging said clamping surfaces to enter into a clamping position in advance of a completion of an advancement of said carriage.

5. A machine according to claim 3, further comprising means for advancing said carriage by two successive displacements for the positioning of the carriage;

wherein a first of said two displacements of the carriage brings said piercing tool into operative engagement with said ram, and a second of said two displacements serves to bring an upper tool which is adjacent said piercing tool into operative engagement with said ram.

6. A machine according to claim 5, wherein said clamping surfaces maintain a clamping position during said two successive displacements.

7. A machine according to claim 5, further comprising a first drive and a second drive for providing respectively said first displacement path of the carriage and said second displacement path of said carriage.

8. A machine according to claim 7, wherein said first drive includes a spring-action free path to permit said carriage to undergo said second displacement upon operation of said second drive.

9. A machine according to claim 7, further comprising a control lever operative under program control in response to movement of said first carriage arm, said control lever directing operation of said second drive.

10. A machine according to claim 5, wherein said advancing means provides said second displacement of said carriage upon the occurrence of an intermediate position of a working stroke of said ram.

11. A machine according to claim 3, further comprising a finger guard which is movable for positioning one of said clamping surfaces which lies above the location of the material to be clamped.

12. A machine according to claim 3, wherein one of said clamping surfaces positioned below the location of the material comprises two lower clamping sections lying one behind the other in the direction of displacement of said carriage, a first of said lower clamping sections being a part of a protective hood and a second of said lower clamping sections being a part of platform that support the material;

wherein said machine includes a spring means for urging said first lower clamping section in a clamping direction toward the location of the material, said second lower clamping section being operatively coupled to said carriage to undergo movement in the clamping direction in response to displacement of said carriage.

13. A machine according to claim 1, wherein said first carriage arm is an upper arm and said second carriage arm is a lower arm; and said upper arm guides said upper tools in a vertically displaceable manner transverse to a direction of displacement of said carriage.

14. A machine according to claim 1, further comprising a guide plate disposed alongside a path of travel of said carriage and having an oblique slot guide providing for vertical displacement of individual ones of said upper tools during a displacement of said carriage.

15. A machine according to claim 1, wherein said ram has a coupling attachment; and said head parts of respective ones of said upper tools have two opposed grooves for receiving said coupling attachment of said ram.

16. A machine for attachment of buttons or rivets to material of articles of clothing, wherein each button or rivet comprises an upper part and a lower part, the machine comprising:

a plurality of upper tools, a plurality of lower tools, a ram operatively coupled to individual ones of said upper tools and said lower tools, a first magazine and a second magazine for storing respectively the upper parts and the lower parts of a plurality of buttons or rivets;

wherein an upper part carried by an upper tool and a lower part carried by a lower tool are brought by a stroke of said ram at a location in said material into form-locked connection with each other;

the machine further comprises a U-shaped carriage having an upper arm and a lower arm, a first drive for operating said carriage and a second drive for operating said carriage;

wherein said upper tools and said lower tools are arranged opposite each other, said upper tools being arranged in a row on said upper carriage arm, and said lower tools being arranged in a row on said lower carriage arm;

operation of said carriage serves to position one of said upper tools into a coupling position with said ram to be driven by said ram;

there being three of said upper tools arranged in said row of upper tools, including a piercing tool located in the middle of said row of upper tools;

said first and said second drives provide respectively for two successive displacements in a position of said carriage, said first displacement bringing said piercing tool into a coupling position with said ram, and said second displacement bringing a further upper tool adjacent said piercing tool into a coupling position with said ram; and said first drive comprises a cam mechanism including a control arm and a pin, a first arm and a second arm extending from said control arm to envelop said pin, and a spring urging said first arm and said second arm together, said pin being located on said carriage.

* * * * *